US007380921B2

(12) United States Patent
Nanjo et al.

(10) Patent No.: US 7,380,921 B2
(45) Date of Patent: Jun. 3, 2008

(54) LIQUID-FEEDING SYSTEM

(75) Inventors: Tatsuo Nanjo, Tokyo (JP); Ryoichi Matsumoto, Tokyo (JP); Ryoji Inoue, Tokyo (JP); Hideki Ogura, Tokyo (JP); Satoshi Oikawa, Tokyo (JP); Ken Hosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 442 days.

(21) Appl. No.: 10/948,919

(22) Filed: Sep. 24, 2004

(65) Prior Publication Data

US 2005/0068385 A1 Mar. 31, 2005

(30) Foreign Application Priority Data

Sep. 29, 2003 (JP) ..... 2003-338725

(51) Int. Cl.
*B41J 2/17* (2006.01)

(52) U.S. Cl. ..... 347/84

(58) Field of Classification Search ..... 347/84–86
See application file for complete search history.

(56) References Cited

U.S. PATENT DOCUMENTS 5,363,130 A * 11/1994 Cowger et al. ..... 347/92
5,742,308 A * 4/1998 Cowger et al. ..... 347/85
5,801,737 A 9/1998 Sato et al.
5,905,518 A * 5/1999 DeFilippis ..... 347/85
6,022,102 A 2/2000 Ikkatai et al.
6,347,863 B1 2/2002 Yuen
6,520,630 B1 2/2003 Oda et al.
6,640,984 B2 11/2003 Gearin et al.
2003/0035036 A1 2/2003 Ogura

FOREIGN PATENT DOCUMENTS

JP 05-096744 4/1993
JP 08-187874 7/1996
JP 2002-361883 12/2002

* cited by examiner

*Primary Examiner*—Stephen Meier
*Assistant Examiner*—Geoffrey Mruk
(74) *Attorney, Agent, or Firm*—Canon U.S.A. Inc I.P. Div

(57) ABSTRACT

A liquid-feeding system efficiently transferring liquid from a liquid storage to a liquid chamber and efficiently transferring gas from the liquid chamber to the liquid storage. The liquid-feeding system includes a liquid-using unit, the liquid storage, the liquid chamber in communication with the liquid-using unit, a plurality of communication paths facilitating communication between the liquid chamber and the liquid storage, the liquid chamber having a substantially enclosed space except where the space communicates with the plurality of communication paths and with the liquid-using unit, a pressure regulator disposed in the liquid storage and regulating the internal pressure of the liquid storage, and means for changing an internal pressure of the liquid chamber relatively higher than an internal pressure of the liquid storage.

6 Claims, 20 Drawing Sheets

SURFACE-TENSION $\gamma i$ OF INK

SURFACE-TENSION $\gamma b$ OF MEMBER MAKING UP FLOW PATH

INTERFACIAL TENSION $\gamma ib$ BETWEEN INK AND FLOW PATH

| | LIQUID CHAMBER | |
|---|---|---|
| | BEFORE PRESSURIZATION | AFTER PRESSURIZATION |
| PRESSURE | Ph | Ph' |
| VOLUME | Vh | Vh' |

| | LIQUID CHAMBER | |
|---|---|---|
| | BEFORE PRESSURIZATION | AFTER PRESSURIZATION |
| PRESSURE | Ph | Ph' |
| TEMPERATURE | Th | Th' |

| | INK-STORING CHAMBER | |
|---|---|---|
| | BEFORE DEPRESSURIZATION | AFTER DEPRESSURIZATION |
| PRESSURE | Pt | Pt' |
| VOLUME | Vt | Vt' |

LIQUID-FEEDING SYSTEM

CROSS REFERENCE TO RELATED APPLICATIONS

This application claims priority from Japanese Patent Application No. 2003-338725 filed Sep. 29, 2003, which is hereby incorporated by reference herein.

BACKGROUND OF THE INVENTION

1. Field of the Invention

The present invention relates to a fluid-communication mechanism for stably and effectively feeding liquid such as ink to, for example, a recording head or a pen as a liquid-using unit from an ink tank or the like serving as a liquid-storage and also for ejecting gas existing in the liquid-using unit to the liquid storage.

2. Description of the Related Art

Inkjet recording apparatuses form an image on a recording medium by accreting liquid ink onto the recording medium with a liquid-using unit, such as an inkjet recording head. These inkjet recording apparatuses have been used in recent years for performing a variety of printing job types, including color printing, since these apparatuses are relatively quite during recording and also allow small dots to be densely formed. One such inkjet recording apparatus includes an inkjet recording head receiving ink fed from an ink tank undetachably or detachably fixed to the apparatus; a carriage having the recording head mounted thereon so as to cause the recording head to relatively scan over a recording medium in a predetermined direction; and transporting means relatively transporting the recording medium in a direction perpendicular to the above-mentioned predetermined direction (that is, in a sub-scanning direction) and performs recording while discharging ink during the main scanning process of the recording head. Also, some of them have recording heads mounted on the carriage, discharging respective kinds of color ink, such as black, yellow, cyan, and magenta ink, so as to perform not only monochrome printing of a text image with black ink but also full color printing by changing the discharge ratio among these kinds of color ink.

In such an inkjet recording apparatus, gas, such as air entering an ink-feeding pathway or existing in the ink-feeding path, must be appropriately ejected.

Gas entering the ink-feeding pathway is generally classified into the following four types depending on where it comes from:

(1) gas entering from an ink-discharge port of a print head or generated in accordance with a discharging operation of the same;

(2) gas dissolved in ink;

(3) gas entering from outside through base material of which the ink-feeding pathway is composed, due to gas perminance; and (4) gas entering when a cartridge-type ink tank is replaced with a new one.

Since a liquid path formed in an inkjet recording head has a very fine structure, ink fed from an ink tank to the recording head is required to be kept in a clean state in which no foreign particles such as dust is mixed. That is, when foreign particles such as dust are mixed, the foreign particles can clog in a discharge port, which is an especially narrow part of an ink flow path, or in a liquid flow path in direct communication with the discharge port, thereby sometimes preventing the recording head from performing a normal ink-discharging operation or from recovering its normal function.

In view of the above problem, many inkjet recording apparatuses generally have a filter member disposed in the ink flow path extending between the recording head and an ink-feeding needle protruding into the ink tank for preventing foreign particles from entering the recording head.

In recent years, in order to achieve high-speed recording, the number of discharge ports has increased, and a drive signal applied on an element generating energy for discharging ink has a higher frequency, thereby resulting in rapid increase in consumption of ink per unit time.

Although the above rapid increase causes an increase in ink passing through the filter member as a matter of course, in order to reduce a pressure loss caused by the filter member, it is effective to enlarge a part of the ink-feeding pathway so that the filter member disposed in the ink-feeding pathway has a large area. With this structure, when bubbles enter the ink-feeding pathway, they are likely to remain upstream of the filter member in the enlarged part of the ink-feeding pathway and are unlikely to be ejected, thereby preventing ink from being smoothly fed. Also, there is a risk that a fine bubble formed from gas remaining in the ink-feeding pathway is mixed in ink being introduced to the discharge port and inhibits the ink from being discharged.

Accordingly, it is important that gas remaining in the ink-feeding pathway be smoothly removed, and some methods for solving the above problem are proposed.

One such proposal is a cleaning operation described below.

Since an inkjet recording head performs printing by discharging liquid ink, for example, in a form of a droplet from its discharge port disposed facing a recording medium, the discharge port is sometimes clogged with ink having an increased viscosity, solidified ink due to its evaporation from the discharge port, dust accreted on the discharge port, bubbles entering the liquid path including the corresponding discharge port, or the like, thereby resulting in poor-quality of printing.

As a countermeasure against the above problem, the inkjet recording apparatus has a capping member disposed therein for covering the discharge port of the recording head when the head is in a non-printing operation mode, or a wiping member disposed therein for wiping the surface (discharge-port-forming surface) of the recording head if necessary. The capping member serves as a cap for preventing ink in the discharge port from the above-mentioned dehydration in a printing operation halt mode. Also, when the discharge port is clogged, the capping member covers the discharge-port-forming surface and to solve clogging of the discharge port due to solidification of ink in the discharge port, due to insufficient discharge of ink in the liquid flow path due to its increased viscosity, and due to insufficient discharge of ink due to bubbles mixed in the ink by exerting a negative pressure on the discharge port, generated by, for example, a suction pump in communication with the inside of the capping member so as to suck ink in the discharge port and to eject it from the discharge port.

A process forcefully ejecting ink for solving these problems of insufficient discharge is called a cleaning operation. This cleaning operation is executed, for example, when a print operation is restarted after long halt of the apparatus or when an operator detects deterioration in quality of recording image and operates, for example, a cleaning switch. In addition, a wiping operation is performed by the wiping member having an elastic plate composed of rubber or the like after ink is forcefully ejected as described above.

Also, during an initial filling period for filling ink in the flow path or liquid path of the recording head for the first time, or during the cleaning operation performed when the ink tank is replaced with a new one, bubbles remaining in the ink-feeding pathway are ejected at a high flow speed achieved by exerting a large negative pressure on the capped discharge-port-forming surface by driving the suction pump at high speeds.

Unfortunately, when the area of the filter member is increased so as to inhibit a dynamic pressure of the foregoing filter member, the area of the flow path is also increased. Hence, even when a large negative pressure is generated in the flow path by the foregoing cleaning operation, a high flow speed at which bubbles are effectively transferred is not achieved, whereby it is very difficult to remove bubbles staying in the ink-feeding pathway from the discharge port by the suction pump. In other words, as a condition under which bubbles pass through the filter member with the flow of ink generated by the suction pump, although ink is required to pass through the filter member at a predetermined flow speed or higher, a large difference in pressures between the both sides of the filter member must be generated in order to achieve such a flow speed. In order to achieve such a condition, in general, a flow-path resistance is increased by making the area of the filter member smaller or a suction pump having a larger capacity is used. In the former case, making the filter member smaller causes deterioration in performance of feeding ink to the head. In the latter case, even when removal of gas is tried with a large amount of flowing ink, a large amount of ink is ejected, thereby sometimes ending up consuming an amount of ink more than necessary.

With the above situation in mind, there are two other methods of removing bubbles: (1) ejecting bubbles directly outside; and (2) moving it to an ink tank and trap it in a part of the ink tank, which does not prevent ink from being fed. Although the former requires a structure in which a communication port extending to the outside is disposed in the feeding path, such a method is not preferable because of the following reason.

In many normal inkjet recording apparatuses, in order to prevent ink from leaking accidentally from the discharge port, a capillary-force-generating member such as a form is disposed in the ink tank or a negative pressure is generated in an ink-storing space in the ink tank by disposing an elastic member such as a spring, in a flexible ink-storing bag so as to exert an urging force on the bag and thus to increase the internal volume of the bag. In such a case, when the communication port merely for removing bubbles is disposed in the feeding path, atmospheric air enters the feeding path contrarily from the communication port, resulting in releasing the negative pressure. In order to avoid this problem, a pressure-regulating valve or the like must be disposed in the communication port, thus leading to complicated and increased structures of the ink-feeding system and the recording apparatus including the ink-feeding system. Also, in order to prevent ink from leaking from a bubble-ejection communication port, since a water-repellent film or the like allowing gas to pass therethrough and preventing liquid from passing therethrough must be disposed in the port, or since a device (a mechanism detecting an amount of bubbles, opening or closing the communication port, or the like) is needed, which opens the communication port and ejects bubbles through the port only when bubbles remain in the ink-feeding pathway, thereby resulting in an increased manufacturing cost or a complicated structure having an increased size.

The method of moving bubbles to the ink tank will be discussed. In this case, if ink in the ink tank, having an amount corresponding to the volume of bubbles to be moved to the ink tank can be transferred to the head, this method is preferable because a negative pressure equivalent to a holding force of a meniscus formed in the discharge port can be exerted on the recording head while the internal volume of the ink tank does not fluctuate, and the generated negative pressure is kept constant. Also, if bubbles can be moved to the ink tank, and when the ink tank is of a cartridge type, since it is replaced with a new one upon having no ink stored therein and accordingly the bubbles can be completely removed from the ink-feeding line, this structure is preferable.

However, many inkjet recording apparatuses widely available in the market as consumer-oriented products have a structure in which cartridge-type ink tanks having black ink and respective kinds of color ink stored therein are detachably placed on the recording head or the carriage having the recording head mounted thereon from above. That is, many ink cartridges feed ink to the recording head by having, for example, a hollow ink-feeding needle protruding therein, mounted upward on the carriage. Accordingly, the inside tube diameter of the ink-feeding needle connecting the ink cartridge and the recording head to each other is a matter of discussion. That is, although, the feeding needle is required to be thin for easily placing the cartridge with a small force, the smaller the internal tube diameter, a meniscus force becomes greater accordingly, whereby bubbles are unlikely to move smoothly.

Meanwhile, some mechanisms for moving bubbles to the ink tank are proposed.

For example, Japanese Patent Laid-Open No. 5-96744 discloses a structure in which the recording head is separated into a first compartment including an atmosphere communication port and a second compartment including a capillary-force-generating member, the first compartment and the ink tank are connected by at least two communication paths having openings in the first compartment, whose heights are different from each other, and air is fed to the ink tank through one of the communication paths. With such a structure, a negative pressure is exerted on the recording head with the head between the first compartment and the second compartment or by the capillary-force-generating member disposed in the second compartment, and the first compartment has the atmosphere communication port disposed therein.

Unfortunately, the structure disclosed in Japanese Patent Patent Laid-Open No. 5-96744 is intended to introduce air into an undeformable ink tank in accordance with ink-feeding so as to use up ink in the ink tank, and is not intended to eject bubbles remaining in the ink-feeding pathway to the ink tank. That is, the art disclosed in the above patent document is not applicable for transferring gas in the ink-feeding pathway, in particular, in the second compartment or in the recording head, to the ink tank.

As another proposal, U.S. Pat. No. 6,460,984 discloses a structure in which, when a chamber for storing a negative-pressure-generating member and a liquid-storing chamber are disposed so as to be separable from each other, a gas priority vent path and a drain path are disposed in a connecting portion connecting these chambers so as to reliably introduce gas to the liquid-storing chamber. However, in the structure disclosed in this patent document, the ink tank and the recording head likewise have a capillary-force-generating member and an atmosphere communication port disposed therebetween, and gas can enter or come out freely through an opening of an ink-feeding path as the atmosphere communication port. Hence, similar to Japanese Patent Patent Laid-Open No. 5-96744, the ink-feeding path is open to the atmosphere; accordingly, the art disclosed in this patent document is not applicable for ejecting bubbles remaining in the ink-feeding pathway.

In addition, U.S. Pat. No. 6,347,863 discloses an ink container (50) having a structure in which drain conduits (66, 72, 74) and vent conduits (76, 82, 84) protrude downward, each drain conduit has an upper opening in the bottom of the inner wall, and each vent conduit has an opening disposed in the ink storing space of the container. An object of the art disclosed in the above patent document is intended to make up a system for refilling a member (14) including reservoirs (16, 18, 20) with ink, and is not intended to remove bubbles remaining in the ink-feeding pathway downstream of the reservoirs or in an ink-using unit. Also, since the heights of lower openings of the drain conduit and the vent conduit are not equal to each other, a meniscus once formed in either conduit may prevent liquid or gas from moving. Although no description about the atmosphere communication port is found in the above patent document, when a system made up by the ink container 50 and the member 14 has an enclosed structure, since continuous use of ink causes the inner negative pressure of the system to increase rapidly and hence makes it impossible to feed ink to the ink-using unit, it is imagined that an atmosphere communication port is disposed in any one of components. In view of the structure of each of the reservoirs (16, 18, 20) having a form (90) stored therein and the structures and the functions of the ink container, the vent conduits, and so forth shown in FIG. 2 in the patent document, it is imagined that each of the reservoirs (16, 18, 20) has an atmosphere communication port disposed therein. In either case, the art disclosed in the document has no intention to positively eject bubbles generated from any of the gas generally classified into the above-described (1) through (4) and remaining in the ink-feeding pathway.

Further, U.S. Pat. No. 6,022,102 discloses a structure in which, a refilling tank for refilling a reservoir tank including a chamber for storing a negative-pressure-generating member and an ink-storing chamber with ink can be connected to the reservoir tank, and when the refilling tank is connected to the same in the upper and lower parts of the space of the ink-storing chamber, while ink is introduced from the refilling tank to the ink-storing chamber through a liquid communication conduit lying in the lower part, air is introduced from the ink-storing chamber to the refilling tank through a gas communication conduit lying in the upper part. However, the structure disclosed in the above patent document, in which the ink-storing chamber and the recording head likewise have a negative-pressure-generating member and an atmosphere communication port disposed therebetween, essentially makes no difference from those disclosed in Japanese Patent Patent Laid-Open No. 5-96744 and U.S. Pat. No. 6,460,984; accordingly, the art disclosed in the above-document is inapplicable for ejecting bubbles remaining in the ink-feeding pathway.

Also, as shown in FIG. 20, U.S. Pat. No. 6,520,630 discloses the structure of an ink-feeding system in which a sub-tank 1022 for refilling a main tank 1020 in communication with a recording head 1018 with ink is placed on the top of the main tank, in accordance with acceleration or deceleration of a carriage, while gas in the main tank is introduced to the sub-tank, ink in the sub-tank is fed to the main tank. In the structure disclosed in the above-document, although ink is stored in the main tank in communication with the sub-tank in a free state, the main tank includes means for introducing atmospheric air into the main tank, whereby the structure essentially makes no difference from those disclosed in Japanese Unexamined Patent Application Publication No. 5-96744, and U.S. Pat. Nos. 6,460,984 and 6,022,102. In other words, the art disclosed in the above document has no intention to positively eject bubbles generated from any of the gas generally classified into the above-described (1) through (4) and remaining in the ink-feeding pathway.

Common structures disclosed in Japanese Patent Laid-Open No. 5-96744, U.S. Pat. Nos. 6,460,984, 6,022,102, and 6,520,630 are a detachable liquid storage (ink tank) in communication with the recording head through a plurality of communication paths, and atmospheric air-introducing means provided downstream of the communication paths (close to the recording head). Problems of the common structures will be described below with reference to U.S. Pat. No. 6,520,630.

FIG. 20 is a conceptual view illustrating the structure of an ink-feeding system disclosed in U.S. Pat. No. 6,520,630. Assuming that air movement (air movement to a sub-ink chamber 1081 of the sub-tank 1022 through a pipe 1056A) is at a halt in a state illustrated in the figure, the balance among forces exerted on a meniscus formed in the pipe 1056A will be discussed. Downward forces consists of a pressure Ha generated due to the head between the ink level in the sub-ink chamber 1081 and the position of a meniscus formed in the pipe 1056A and a meniscus force MA. Also, an upward force is a pressure P generated due to air stored in an ink bag 1100 disposed in the main tank 1020. With all these forces being balanced, the air movement is at a halt. In this case, the air pressure P balances with the sum of the pressure HA generated due to the head between the ink level in the sub-ink chamber 1081 and the meniscus position in the pipe 1056A (P=HA+MA). In addition, since ink in the sub-ink chamber 1081 and that in the ink bag 1100 are in communication with each other through a pipe 1056B, a difference in a downward ink pressure exerted on the meniscus formed in the pipe 1056A and the air pressure in the ink bag 1100 is equal to a pressure HB−HA generated due to the head between the meniscus position in the pipe 1056A and the ink level in the ink bag 1100. Resultantly, the pressure HB−HA generated due to the above head balances with the meniscus pressure MA, thereby keeping the equivalent state.

When ink is further consumed in this state, and the ink level in the ink bag 1100 is lowered because of, for example, introduction of bubbles from a bubble-generating device 1104, the pressure HB−HA generated due to the head between the meniscus position in the pipe 1056A and the ink level in the ink bag 1100 increases, and when it finally exceeds the meniscus pressure, air is introduced to the sub-ink chamber 1081, whereby ink in the sub-ink chamber 1081 is fed to the ink bag 1100.

However, when ink is discharged by the recording head 1018, since ink flows through the entire feeding system, a pressure loss occurs between the sub-ink chamber 1081 and the ink bag 1100 in accordance with a flow rate in the pipe 1056B. Accordingly, in addition to the foregoing meniscus pressure MA and the pressure HB−HA generated due to the head between the meniscus position and the ink level in the ink bag 1100, the pressure loss must be taken into account. As a result, the air movement occurs when the pressure generated due to the head between meniscus position and the ink level in the ink bag 1100 is greater than the sum of the foregoing meniscus pressure and the pressure loss. In other words, in comparison to the air-movement halting state, in an ink-discharging state or dynamic state, exchange between gas and liquid (hereinafter, simply referred to as gas-liquid exchange) does not take place only after the ink level in the ink bag 1100 is further lowered by an amount corresponding to the pressure loss in the pipe 1056B in accordance with the flow rate in the same. When the ink level at which the gas-liquid exchange starts to take place is lowered than the opening of the pipe 1056B, the gas-liquid exchange does not take place, whereby ink in the main tank 1020 is used up while ink in the sub-tank 1022 remains unused.

Accordingly, when the pipe is made thinner in order to easily place the ink tank as described above, since the pressure loss increases accordingly, the fact that the liquid level in the main tank at which the gas-liquid exchange starts to take place is lowered in accordance with an increase in the pressure loss must be taken into account. In other words, the size of the main tank inevitably increases, thereby leading to an increased size of the entire recording apparatus.

In addition, the structure shown in FIG. 20 has another problem in that the bubble-generating device 1104 is disposed in the lower part of the main tank. That is, in spite of a strong request about a structure in which transfer of bubbles to the discharge port of ink can be minimized, there is a risk that, in accordance with an ink discharge operation of the recording head, bubbles introduced from the bubble-generating device 1104 are drawn into a flow path 1041 in communication with the recording head 1018, together with ink flowing toward the recording head 1018. Accordingly, in order to prevent such bubbles from being drawn, it is necessary to restrict flow of ink in accordance with the ink discharge operation or to dispose the bubble-generating device 1104 remote from a filter member 1039, and any of these measures causes a further increased size of the main tank 1020.

The structures disclosed in Japanese Patent Laid-Open No. 5-96744, U.S. Pat. Nos. 6,460,984 and 6,022,102, in which the atmospheric air-introducing means is provided downstream of the communication paths, close to the recording head have the same disadvantages as described above.

As described above, although the foregoing Japanese Patent Laid-Open No. 5-96744, U.S. Pat. Nos. 6,460,984, 6,347,863, 6,022,102, and 6,520,630 disclose the art that gas is introduced to the ink tank lying uppermost-stream, but according to these patent documents, any of the purposes that, in an operating state of the apparatus, gas remaining in the ink-feeding pathway having an enclosed structure, that is, the gas generally classified into the foregoing kinds (1) through (4), entering the ink-feeding pathway and staying there is smoothly transferred to the ink tank and that the gas is trapped in the same has not been achieved. In addition, according to the foregoing patent documents, when a flow rate of ink is increased so as to perform high-speed recording, sometimes, the apparatus fails to follow the flow rate for feeding ink and runs out of ink, or bubbles enter the recording head. In order to prevent the above problems, the size of the recording head is inevitably increased.

SUMMARY OF THE INVENTION

The present invention is directed to a liquid-feeding system having an enclosed structure extending to a liquid-using unit, in which gas acting as an obstacle against smooth operations of using and feeding liquid is quickly and smoothly ejected from the liquid-using unit without causing a complicated structure.

Also, the present invention is directed to an inkjet recording apparatus in which gas remaining in the ink-feeding pathway having an enclosed structure is smoothly and quickly transferred to an ink tank, and also, even in an actual operation, poor-quality of recording caused by a problem due to remaining bubbles, that is, caused by clogging of a discharge port due to poor ink-feeding or bubbles entering the discharge port is prevented from occurring.

In one aspect of the present invention, a liquid-feeding system includes a liquid-using unit using liquid; a liquid chamber in communication with the liquid-using unit; a liquid storage storing the liquid; a plurality of communication paths facilitating communication between the liquid chamber and the liquid storage; the liquid chamber having a substantially enclosed space except where the space communicates with the plurality of communication paths and with the liquid-using unit; and a pressure regulator disposed in the liquid storage, for regulating the internal pressure of the liquid storage. The liquid-feeding system further includes means for changing the internal pressure of the liquid chamber relatively higher than the internal pressure of the liquid storage.

In another aspect of the present invention, a fluid-communication mechanism establishing fluid-communication between a liquid storage storing liquid and a liquid-using unit using the liquid, includes a liquid chamber in communication with the liquid-using unit; and a plurality of communication paths facilitating communication between the liquid chamber and the liquid storage. The liquid chamber has a substantially enclosed space except where the space communicates with the plurality of communication paths and the liquid-using unit. Also, in a state in which gas exists in the enclosed space, the gas can be transferred to the liquid storage passing through the plurality of communication paths. The fluid-communication mechanism further includes means for changing an internal pressure of the liquid chamber relatively higher than an internal pressure of the liquid storage so as to facilitate transfer of the gas through at least one of the plurality of communication paths.

In another aspect, an ink-feeding system according to the present invention includes a recording head discharging ink; an ink chamber in communication with the recording head; an ink tank storing the ink; a plurality of communication paths facilitating communication between the ink chamber and the ink tank; and a pressure regulator for regulating the internal pressure of the ink tank. The liquid chamber has a substantially enclosed space formed therein, excepting for the plurality of communication paths and the ink tank. The ink-feeding system further includes means for changing the internal pressure of the liquid chamber relatively higher than the internal pressure of the ink tank.

Another aspect of the present invention is an ink tank feeding ink to a recording head discharging ink via an ink-feeding system extending to the recording head, the ink tank including an ink chamber in fluidic communication with the recording head; a plurality of communication paths facilitating fluid communication between the ink chamber and the recording head; the ink chamber having a substantially enclosed space formed therein except where the space communicates with the plurality of communication paths and the recording head; a pressure regulator regulating an internal pressure of the ink tank; and means for changing an internal pressure of the ink chamber relatively higher than an internal pressure of the ink tank.

Furthermore, an inkjet recording head according to the present invention, performing recording by discharging ink, includes the foregoing fluid-communication mechanism integrally formed therewith.

Moreover, an inkjet recording apparatus according to the present invention includes a recording head discharging ink toward a recording medium; an ink tank storing ink to be fed to the recording head; the foregoing fluid-communication mechanism; and activating means activating the pressure-changing means.

According to the present invention, in the liquid-feeding system having an enclosed structure extending to a liquid-using unit, gas acting as an obstacle against smooth operations of using and feeding liquid is quickly and smoothly ejected from the liquid-using unit without causing a complicated structure. In particular, even when bubbles and liquid exist intermittently in one of the communication paths and multiple meniscuses are formed in the communication path, by changing the magnitudes of the internal pressures of the liquid chamber and the liquid storage relative to each other by the pressure-changing means, the multiple meniscus state is resolved, whereby gas is more smoothly transferred.

Still further, when the present invention is applied to an inkjet recording apparatus, gas staying in the ink-feeding pathway having an enclosed structure can be smoothly and quickly transferred to an ink tank. In addition, even in an actual operation, poor-quality of recording caused by a problem due to the above-mentioned remaining bubbles, that is, caused by clogging of a discharge port due to poor ink-feeding or bubbles entering the discharge port can be prevented.

Further features and advantages of the present invention will become apparent from the following description of the embodiments with reference to the attached drawings.

DESCRIPTION OF THE EMBODIMENTS

Embodiments of the present invention applied to inkjet recording apparatuses will be described with reference to the attached drawings.

In the following description, the term "recording" means not only forming meaningful information such as a character, a figure, or the like, but also forming an image, a pattern, or the like on a recording medium regardless of being meaningful or being visual, or processing a recording medium.

Also, although the term "recording medium" means not only a cut sheet used in a general recording apparatus but also a plastic film, a metal plate, a sheet of glass, cloth, ceramic, wood, leather or the like, which are receptible to ink, in the following description it refers to as a sheet of paper or simply to as a cut sheet.

Meanwhile, although ink serves as liquid used in liquid-feeding systems according to the following embodiments of the present invention by way of example, applicable liquid is not limited to ink, and those skilled in the art will appreciate that, for example, in the ink-jet recording field, treating liquid for a recording medium is also included.

First Embodiment

The entire structure of an ink-feeding system will be described.

Figure 1:
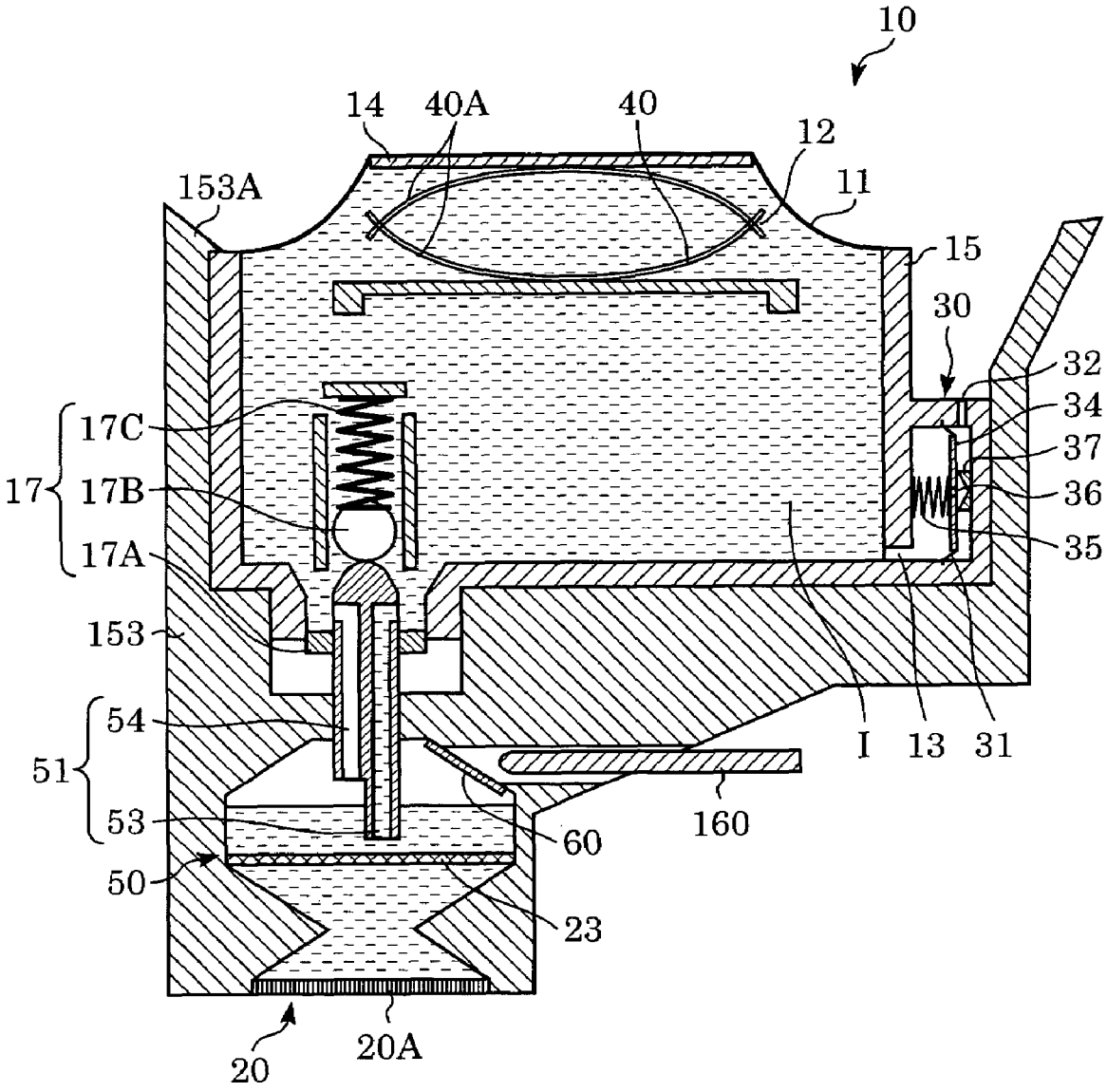
FIG. 1 is a schematic sectional view of a liquid-feeding system according to a first embodiment of the present invention.

FIG. 1 is a schematic sectional view of a liquid-feeding (ink-feeding) system according to a first embodiment of the present invention.

The ink-feeding system according to the first embodiment shown in FIG. 1 generally includes an ink tank 10 serving as a liquid container, an inkjet recording head (hereinafter, simply referred to as a recording head) 20, and a liquid chamber 50 communicating these two components with each other and forming an ink-feeding path. The liquid chamber 50 may be separable or inseparable from the recording head 20. In the example system shown in FIG. 1, in a serial-scanning-type recording apparatus, a carriage 153 having the recording head 20 mounted thereon has the liquid chamber 50 disposed therein and the ink tank 10 detachably disposed thereon from above. Also, in a placement state of the ink tank 10, an ink-feeding pathway extending from the ink tank 10 to the recording head 20 is formed in an enclosed manner. The liquid chamber 50 substantially has an enclosed space, except where it connects with the ink tank 10 and the recording head 20, and includes no atmospheric air-introducing means.

The ink tank 10 includes two chambers: an ink-storing chamber 12 defining an ink-storing space and a valve chamber 30. The two chambers are in communication with each other through a communication path 13. The ink-storing chamber 12 stores ink to be fed to the recording head 20 in accordance with a discharge operation of the same so as to be discharged from the same. Also, the ink-storing chamber 12 has a sealing member 17 disposed therein in its accepting portion for accepting a connecting portion 51 of the liquid chamber 50, which will be described later. In this example system, the sealing member 17 forms an opening through which the connecting portion 51 protrudes. The sealing member 17 includes a seal member 17A composed of an elastic material such as rubber and disposed so as to extend at least around the opening; a ball-shaped valve element 17B closing the opening; and a spring 17C urging the valve element 17B toward its closing position. Meanwhile, even in a non-placement state of the ink tank 10, the internal pressure of the ink tank 10 is negative due to an action of a spring 40, which will be described later. Hence, it is desirable to determine an appropriate strength of the spring 17C so that the valve element 17B reliably seals the foregoing opening so as to prevent ink from leaking through the opening of the seal member 17A even in the non-placement state of the ink tank.

The sealing member 17 may be formed by, for example, a rubber member having a slit or the like allowing the connecting portion 51, which will be described later, to easily extend therethrough. With this structure, when the connecting portion 51 does not extend through the sealing member 17, the slit is closed due to the elastic force of the rubber member, thereby preventing leakage of ink.

The ink-storing chamber 12 has a deformable flexible film (sheet member) 11 partially disposed therein. The sheet member 12 and an inflexible outer casing 15 define the ink-storing space. An outside space of the ink storing space when viewed from the sheet member 11 (i.e., a space lying above the sheet member 11 in FIG. 1) is open to the atmosphere and is at the atmospheric pressure. Also, this ink-storing space substantially forms an enclosed space, except for the accepting portion lying in the lower part thereof for accepting the connecting portion 51 of the liquid chamber 50 and the communication path 13 extending to the valve chamber.

The shape of the central part of the example sheet member 11 is regulated by a flat pressure plate 14 serving as a support member. The peripheral part of the sheet member 11 is deformable. Also, the sheet member 11 is formed so as to have a projected central part and an approximately trapezoidal side surface. As will be described later, the sheet member 11 is deformed in accordance with a change in an amount of ink or pressure fluctuations in the ink storing space. Since the peripheral part of the sheet member 11 expands and contracts in a well balanced manner, the central part of the sheet member 11 moves vertically as shown in FIG. 1, while being kept in a substantially horizontal position. Since the sheet member 11 is deformed (moves) smoothly as described above, no shock occurs due to the deformation, and accordingly no abnormal fluctuations in pressure due to shock occur in the ink-storing space.

The ink-storing space has the spring 40 disposed therein. By urging the sheet member 11 in the upward direction in FIG. 1 through the pressure plate 14, the spring 40 generates a negative pressure equivalent to holding forces of meniscuses formed in ink-discharging portions 20A of the recording head 20, and in a range where the recording head 20 can perform an ink-discharging operation. At the same time, when the volume of air in the ink-storing chamber 12 fluctuates in accordance with an environmental change (for example, a change in ambient temperature or pressure), the volume fluctuation of air is accepted by displacements of the spring and the sheet, whereby the negative pressure in the space does not fluctuate so much. Although FIG. 1 shows a state in which ink is almost fully filled in the ink-storing space, even in this state the spring member 40 urges the sheet member 11 upward in the above described manner so as to generate an appropriate negative pressure in the ink-storing space.

The spring 40 in the example liquid-feeding system is a combination of a pair of leaf spring members 40A, each having an approximate U-shaped cross-section and is formed such that the open ends of the U-shaped leaf spring members face each other, in the same fashion as disclosed in U.S. Published Application 20030035036 proposed by the same applicants. As a form of this combination, each leaf spring member 40A may have a depression and a projection formed at both ends thereof so that the depression and the projection of one of the pair of leaf spring members engage with corresponding projection and depression of the other leaf spring member. Alternatively, the spring 40 can be a coil spring, or a cone-shaped helical spring.

When negative pressure in the ink tank 10 becomes equal to a predetermined value or higher, gas (air) is introduced in the valve chamber 30 from outside. Also, the valve chamber 30 has a one-way valve disposed therein so as to prevent ink from leaking from the ink tank 10. The one-way valve includes a pressure plate 34, including a communication port 36, serves as a valve-closing member; a seal member 37 fixed on the inner wall of the valve chamber so as to face the communication port 36 and being capable of sealing the communication port 36; and a sheet member 31 bonded to the pressure plate and having the communication port 36 extending therethrough. The valve chamber 30 also has a substantially enclosed space therein, except for the communication path 13 extending to the ink tank 10 and the communication port 36 extending to the atmosphere. A space on the right side of the sheet member 31 in a housing of the valve chamber in FIG. 1 is open to the atmosphere through an atmosphere communication port 32 and is at the atmospheric pressure.

The sheet member 31 has a structure in which its peripheral part is deformable, its central part bonded to the pressure plate 34 has a projected shape, and its side surface has an approximately trapezoidal shape. With this structure, the pressure plate 34 serving as a valve-closing member moves smoothly in the horizontal direction in FIG. 1.

The valve chamber 30 has a spring member 35 disposed therein, serving as a valve-regulating member, for regulating a releasing operation of the valve. In the example liquid-feeding system shown in FIG. 1, the spring member 35 has a coil spring shape and is set in a slightly compressed state so as to press the pressure plate 34 rightward in FIG. 1 with its compression force. Since expansion or contraction of the spring member 35 causes the seal member 37 to come into close contact with or to come off from the communication port 36, the valve chamber 30 serves as a valve and also has an one-way valve mechanism allowing introduction of air only from the atmosphere communication port 32 to the valve chamber 30 through the communication port 36. Likewise, the spring member 35 is not limited to a coil spring as shown in FIG. 1, but those skilled in the art will appreciate that it may be a cone-shaped helical spring or the like.

The seal member 37 may have any structure or be composed of any material as long as it reliably seals the communication port 36. That is, it may have a structure in which the part coming into contact with the communication port 36 has a shape maintaining flatness against the opening-forming surface of the communication port, may have a rib capable of coming into close contact with the periphery of the communication port 36, or may have a top protruding into the communication port 36 and closing the same as long as the seal member 37 establishes a close contact state with the communication port 36. Although the seal member 37 may be composed of any material, since the foregoing close contact is established by a load of stretching of the spring member 35, the seal member is further preferably composed of a member, that is, an elastic member composed of contractible rubber, easily following the movements of the sheet member 31 and the pressure plate 34 which move in accordance with the load of stretching.

With such a structure of the ink tank 10, the components of the ink tank 10 are designed such that, when ink in the ink tank is consumed from its initial state of fully filling the ink tank therewith and is continuously further consumed from a state in which a negative pressure in the ink-storing chamber 12 is balanced with a force exerted by the valve-regulating member in the valve chamber 30 and so forth, and, at the moment when the negative pressure further increases, the communication port 36 is opened; thus, atmospheric air is taken into the ink-storing space. With this taking-in of atmospheric air, the volume of the ink-storing chamber 12 increases since the sheet member 11 or the pressure plate 14 is displaceable upward in FIG. 1, and at the same time, the negative pressure decreases, whereby the communication port 36 is closed.

Also, even when the ambient environment of the ink tank changes, for example, ambient temperature increases or ambient pressure decreases, since the air drawn into the ink-storing space is allowed to expand by a volume equivalent to that in the ink-storing space from the most downwardly displaced position of the sheet member 11 or the pressure plate 14 to its initial position. In other words, since a space corresponding to the foregoing volume serves as a buffer area, a pressure rise in accordance with a change in ambient environment is curbed, and leakage of ink from the discharge port is effectively prevented.

Also, since outside air is introduced into the ink-storing space only after the buffer area is established when the internal volume of the ink-storing space decreases in accordance with drainage of ink starting from its initial state of filling the ink tank therewith, for example, even when the ambient environment changes suddenly or the ink tank is dropped, ink is unlikely to leak. In addition, since the buffer area is not previously established in a state in which ink is not yet used, the ink container has a high volumetric efficiency and also a compact structure.

In the example system shown in FIG. 1, the recording head 20 and the ink tank 10 are combined with each other when the connecting portion 51 of the liquid chamber 50 disposed integrally with the recording head 20 is inserted into the ink tank 10. That is, in the case of this example system, the liquid chamber 50 including the connecting portion 51 makes up a fluid-communication mechanism. With this structure, the two components are fluidically combined with each other so as to feed ink toward the recording head 20. In this state, a latch portion 153A disposed on the carriage 153 engages with a part of the outer casing 15 of ink tank 10 so as to maintain the ink tank 10 in the placement state.

The ink-feeding pathway in the liquid chamber 50 has a cross-section becoming wider gradually from the connecting portion with the ink tank 10 (from upstream) and then becoming gradually narrower toward the recording head 20 (toward downstream). The ink-feeding pathway has a filter 23 disposed in its widest part so as to prevent a foreign particle mixed in ink from flowing into the recording head 20. A gas-liquid interface in the liquid chamber 50 formed due to gas remaining in the same has an area greater than a lateral cross-section of either of flow paths 53 and 54. With this arrangement, when the head between liquid levels of ink in the ink tank 10 is exerted on ink in the liquid chamber 50 through the flow path 53, a pressure of gas existing in the liquid chamber 50 increases; hence the gas is easily ejected through the air flow path 54. This gas ejection is further effective since the ink-feeding pathway in the liquid chamber 50 is gradually widened from the connecting portion with the ink tank 10 (from upstream), in other words, the ink-feeding pathway is formed so as to become gradually narrower upward, whereby bubbles are likely to come together in the vicinity of the opening of the air flow path 54 close to the head (hereinafter, the opening close to the head is also referred to as the head-side opening).

The liquid chamber 50 further has an elastic deformable wall (hereinafter, referred to as an elastic wall) 60 disposed therein. The elastic wall 60 can be composed of rubber or the like and surrounding a part of the internal space of the liquid chamber. A pressing force can be exerted on the elastic wall 60 by a pressing member 160 disposed on the main body of the carriage 153. These members serve as pressure-changing means and activating means of the present invention so as to reliably perform the basic operation of gas-liquid exchange, which will be described later.

The recording head 20 has a plurality of the discharge portions 20A arranged in a predetermined direction. For example, in a serial-scanning-type recording apparatus as described above in which a recording head mounted on a member such as a carriage performs a discharge operation while moving relative to a recording medium as described above, in a direction different from the moving direction (a direction orthogonal to the plane of FIG. 1, that is, in a horizontal direction in FIG. 1; liquid paths in communication with respective discharge ports; and elements disposed in the respective liquid paths and generating energy for discharging ink, disposed therein). Meanwhile, the ink-discharging system of the recording head, that is, the energy-generating element is not limited to a specific one. For example, an electrothermal conversion member generating heat in accordance with a current applied thereon may be used as the element so that thermal energy generated by the energy-generating element is used for discharging ink. In this case, heat generated by the electrothermal conversion member causes film-boiling to occur in ink, and bubble-forming energy generated in accordance with the film-boiling causes ink to be discharged from the ink-discharge port. Also, an electro-mechanical transducing element such as a piezoelectric element deformable in accordance with a voltage applied thereon may be used for discharging ink by utilizing its mechanical energy.

Meanwhile, the recording head 20 and the liquid chamber 50 may be separable from each other or be inseparably integrated with each other. Alternatively, they may be separately formed so as to be connected to each other having a communication path interposed therebetween. When they are integrated with each other, they may be constructed in a form of a cartridge detachable on a member (for example, carriage) mounted in the recording apparatus.

Structure and Basic Operation of the Connecting Portion

The connecting portion 51 will now be described. The connecting portion 51 is a hollow needle-shaped member, the inside of which is divided into two hollow parts along the axial direction thereof. The positions of the upper openings of the hollow parts, that is, those lying in the ink-storing chamber 12 (hereinafter, referred to as tank-side opening positions) lie substantially at the same height as each other with respect to the vertical direction. In the meantime, the positions of the lower openings, that is, those lying in the liquid chamber connected to the head (hereinafter, referred to as head-side opening positions) lie at different heights from each other. The difference in the head-side opening positions in the vertical direction is designed to quickly transfer air remaining in the liquid chamber 50 to the ink tank 10 when the ink tank 10 is placed. In the following description, when the head-side opening position in the liquid chamber 50 of one of the two flow paths is relatively lower in the vertical direction than that of the other flow path, the one flow path (lying on the right side in FIG. 1) and the other flow path (lying on the left side in FIG. 1) are respectively called the ink flow path 53 and the air flow path 54 for the sake of convenience. The above naming is due to the fact that, in a bubble-ejecting process, ink is drained to the recording head mainly through the ink flow path 53 and air is transferred to the ink tank mainly through the air flow path 54. However, since both ink and air flow through each flow path as will be described later, the naming does not mean that the respective flow paths are exclusively used for the fluids corresponding to the respective names.

In the state shown in FIG. 1 in which the ink tank 10 is placed, with respect to the vertical direction, the liquid chamber 50 lies substantially lower than the ink tank 10, but higher than the recording head 20. The positions of the two openings of the connection portion 51 within the liquid chamber 50 are different from each other. A pressure difference due to the head between liquid levels of ink in the two flow paths, corresponding to the difference in the heights of the openings close to the head, of these flow paths, and with a pressure difference due to meniscuses formed by ink in the respective flow paths, gas(air) in the liquid chamber 50 moves to the ink tank 10 through the air flow path 54, and also, ink is transferred from the ink tank 10 to the liquid chamber 50 through the ink flow path 53.

The basic operation of the above-described gas-liquid exchange will be described further in detail with reference to FIGS. 2 to 4 as reference drawings for the present embodiment. Meanwhile, in these drawings, the elastic wall 60 and the pressing member 160 are omitted.

Figure 2:
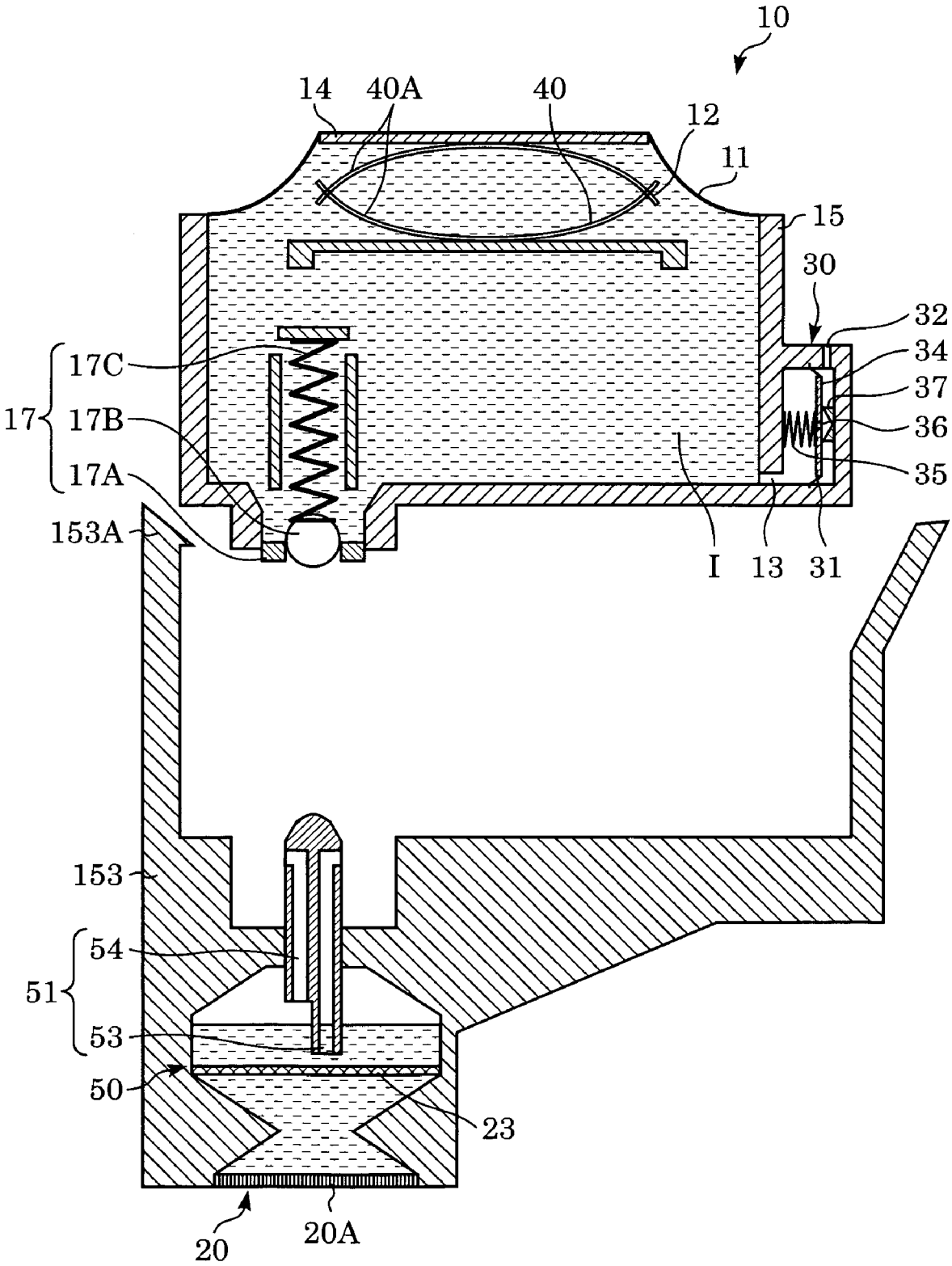
FIG. 2 is a schematic sectional view of the liquid-feeding system in a state in which a new ink tank has not been placed in a liquid chamber or on a recording head.
Figure 3:
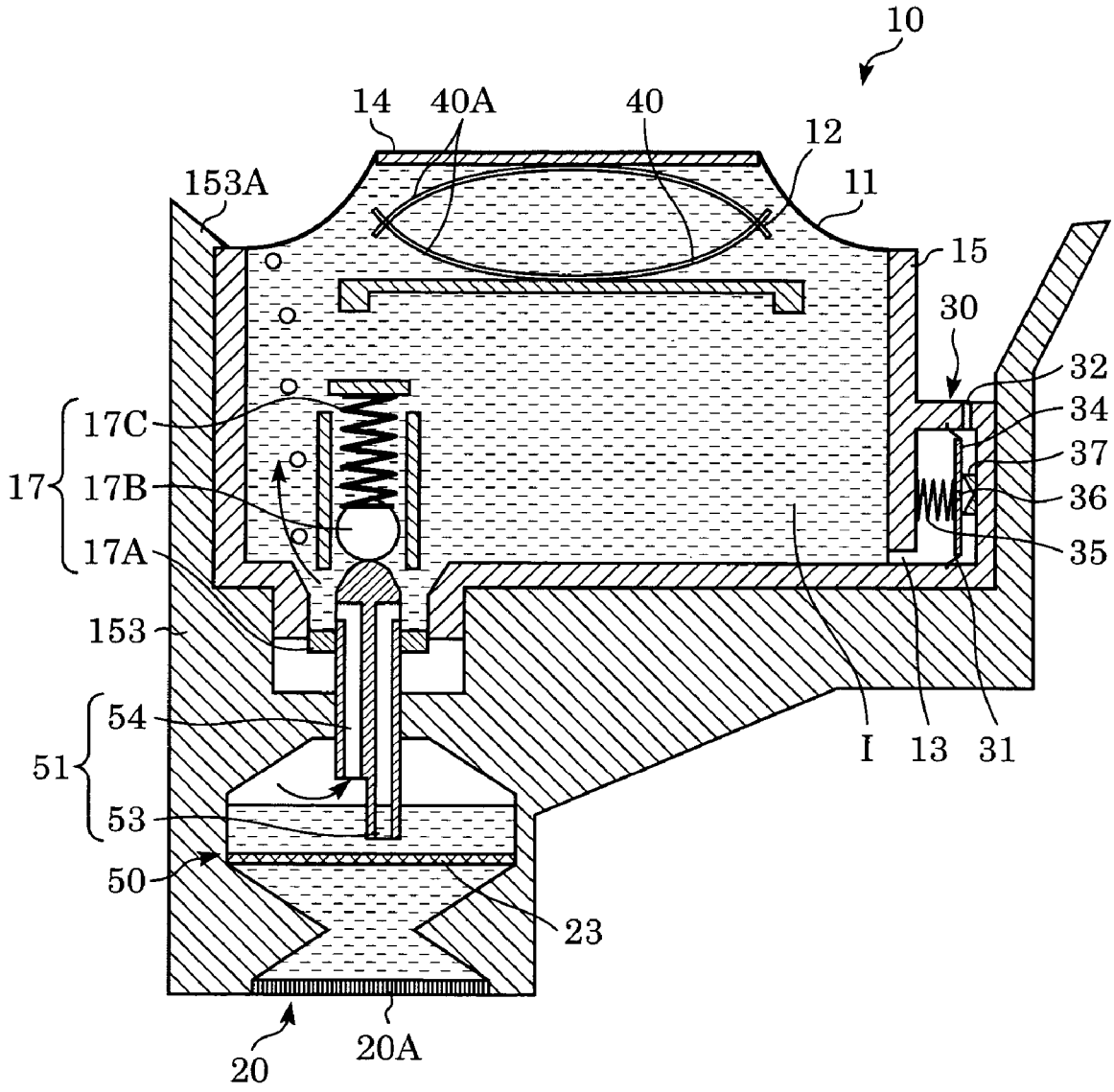
FIG. 3 is schematic sectional view of the liquid-feeding system in a state in which a new ink tank has not been placed in the state shown in FIG. 2 and bubbles are being ejected.
Figure 4:
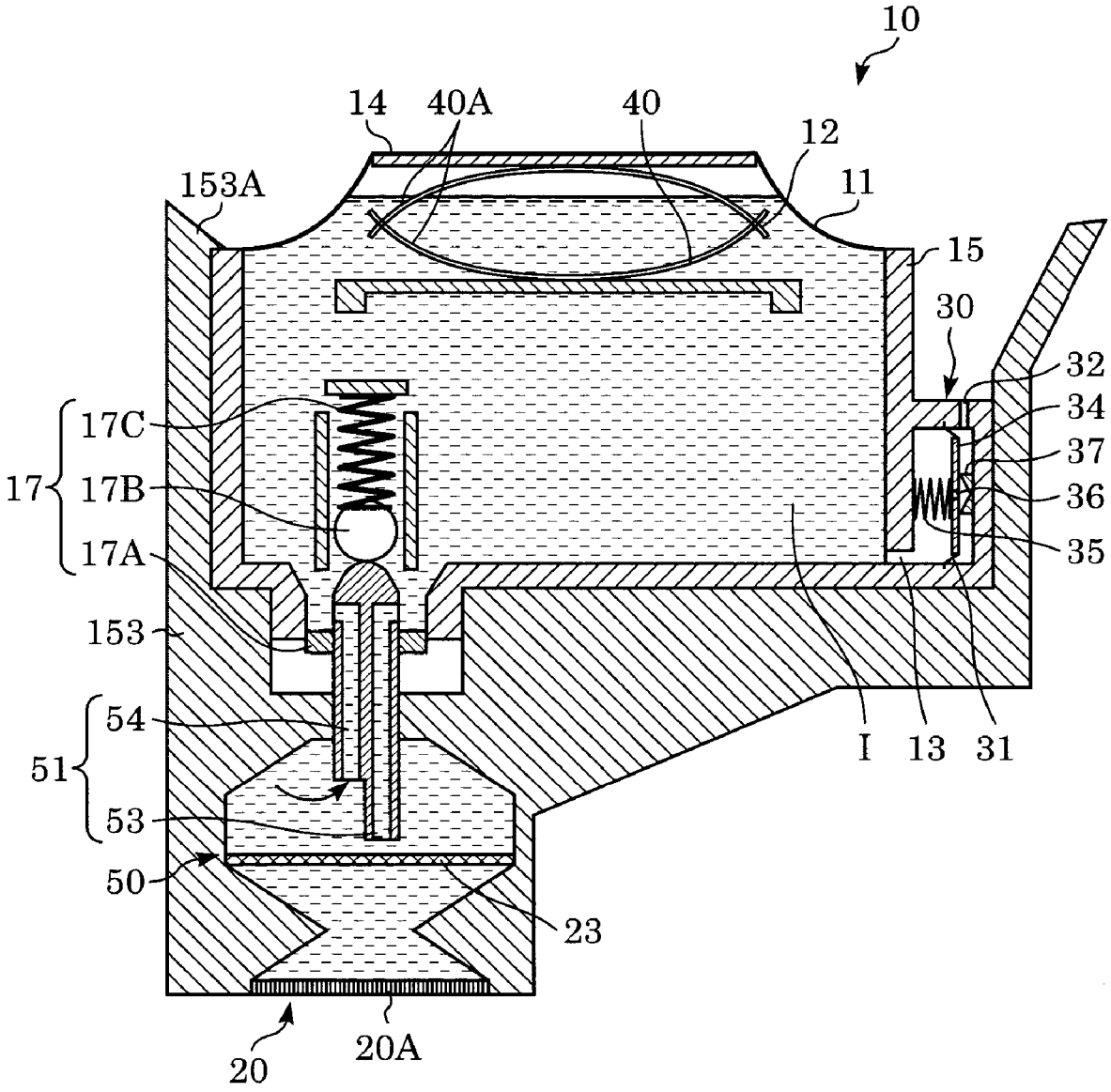
FIG. 4 is schematic sectional view of the liquid-feeding system in a state in which a gas-liquid exchange operation has been finished.

FIGS. 2 to 4 are schematic sectional views of the liquid-feeding system, illustrating a placement process of the new ink tank 10. FIGS. 2 to 4 illustrate respectively states in which the ink tank has not been yet placed, in which air in the liquid chamber is being ejected, and in which the air has been ejected.

In the state shown in FIG. 2, the new ink tank 10 has not been yet placed in the liquid chamber 50 or the recording head 20. The ink tank 10 is completely filled with ink I, a negative pressure is generated in the ink tank 10 due to the spring member 40, and also, the sheet member 11 protrudes toward the outside of the ink tank 10. In the meantime, since the recording head 20 performs recording by using ink remaining in the liquid chamber 50 even when the already placed ink tank 10 runs dry, air enters the liquid chamber 50 from the empty ink tank 10 and stays in the upper part of an area in the liquid chamber 50 upstream of the filter 23.

When the ink tank 10 is placed in this state, since the recording head 20 or the liquid chamber 50 is open to the atmosphere in the state shown in FIG. 2, the pressure of air in the area upstream of the filter 23 is equal to the atmospheric pressure. On the contrary, the internal pressure of the ink tank 10 is made lower than the atmospheric pressure by the spring member 40 (that is, is at a negative pressure). With this structure, at the moment of the ink tank 10 being placed, a part of the air in the area upstream of the filter 23 moves to the ink-storing chamber 12 so as to cause the internal pressures of the ink-storing chamber 12 and the liquid chamber 50 to be averaged. Air remaining in the liquid chamber 50 is subjected to a force causing the air to move toward the ink tank 10 through the air flow path 54 while ink in the ink-storing chamber 12 is subjected to a force equivalent to its own weight causing the ink to move toward the liquid chamber 50 through the ink flow path 53.

Accordingly, when ink is consumed in accordance with an ink-sucking operation or an ink-discharging operation of the discharge port in the initial state after placement of the ink tank, in accordance with a pressure due to a difference in heights (due to the head) between the liquid level in the ink-storing chamber and the opening of the air flow path 54 close to the head and with a pressure due to meniscuses formed in the flow path, as shown in FIG. 3, ink moves to the liquid chamber 50, while air is ejected to the ink tank 10. FIG. 4 illustrates a state in which air in the liquid chamber 50 completely moves to the ink-storing chamber 12. Then, in this state, the ink movement and the air ejection are halted. Such a basic gas-liquid exchange operation in the present embodiment is performed in accordance with ink consumption caused by an ink-sucking operation or an ink-discharging operation of the discharge portion immediately after placement of the ink tank, and, with this operation, removal of bubbles is also finished.

As described above, since air in the liquid chamber 50 is ejected in accordance with placement of the new ink tank 10, air is not guided to the recording head 20. Also, a certain amount of air is allowed to flow in the liquid chamber 50, thereby achieving an excellent advantage of using up ink in the ink tank 10 almost completely.

Subsequently, problems of a multiple meniscus state will be described with reference to FIGS. 5 and 6 as reference drawings for the present embodiment. In these drawings, the elastic wall 60 and the pressing member 160 are also omitted in the same fashion as in FIGS. 2 to 4.

Despite of the above advantage, the present inventors have found that sometimes such a basic gas-liquid exchange operation is inhibited, and transfer of residual air in the liquid chamber is delayed.

Figure 5:
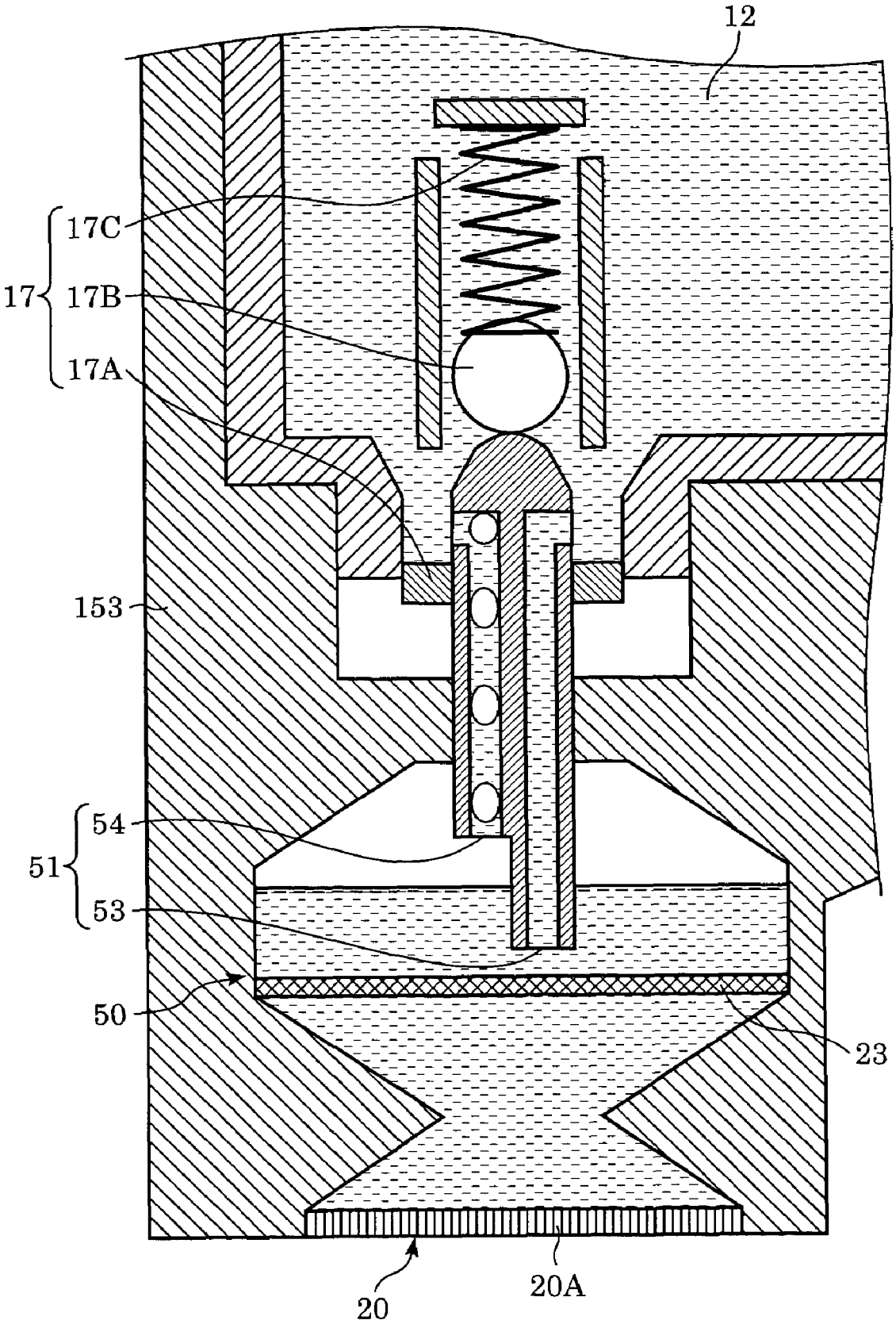
FIG. 5 is schematic sectional view of the liquid-feeding system for illustrating a multiple meniscus state in an air flow path and inhibiting the basic gas-liquid exchange operation.

Referring now to FIG. 5, the multiple meniscus state will be described.

FIG. 5 illustrates a state in which the ink-storing chamber 12 and the liquid chamber 50 are in communication with each other through the connecting portion 51. In this state, although the ink flow path 53 is in a perfect liquid communication state, in the air flow path 54, air partially remains, and air (gas) and ink (liquid) exist intermittently; thus, demonstrating a pattern just looking like the tail of a tiger. As a result, multiple meniscuses are formed in the flow path 54. Hereinafter, such a state will be referred to as a gas-liquid intermittently existing state or a multiple meniscus state.

As described above, air remaining in the liquid chamber 50 is subjected to a force causing the air to move toward the ink tank 10 through the air flow path 54 while ink in the ink-storing chamber 12 is subjected to a force equivalent to its own weight causing the ink to move toward the liquid chamber 50 through the ink flow path 53. However, when the air flow path is in the multiple meniscus state, and when a pressure caused by the multiple meniscuses is greater than a pressure causing ink and air to move, the air transfer is delayed.

The case where the air flow path 54 falls in the multiple meniscus state as described above will be described.

When a recording operation of the recording head is still being performed even when the ink tank 10 nearly runs out of ink, in the ink-consuming process, air is drawn into the liquid chamber 50 from the ink tank 10, thereby sometimes causing both ink and air flow paths 53 and 54 to fall in the multiple meniscus state. That is, when the lowest surface, with respect to the vertical direction, of the ink tank 10 lying in a placed state extends nearly horizontally, and also when the openings of the two flow paths close to the ink tank lie in the vicinity of the lowest surface, ink and air are drawn at the same time into both flow paths 53 and 54 of the connecting portion 51 just before ink in the ink tank 10 is used up, whereby both flow paths are likely to fall in the multiple meniscus state. Meanwhile, in general, since a pressure resistance increases in proportion to the number of meniscuses in a flow path, and the smaller the number of meniscuses, the flow path has a smaller pressure resistance. Hence, of the two flow paths, air is likely to move in the flow path having a smaller number of meniscuses.

Figure 6A:
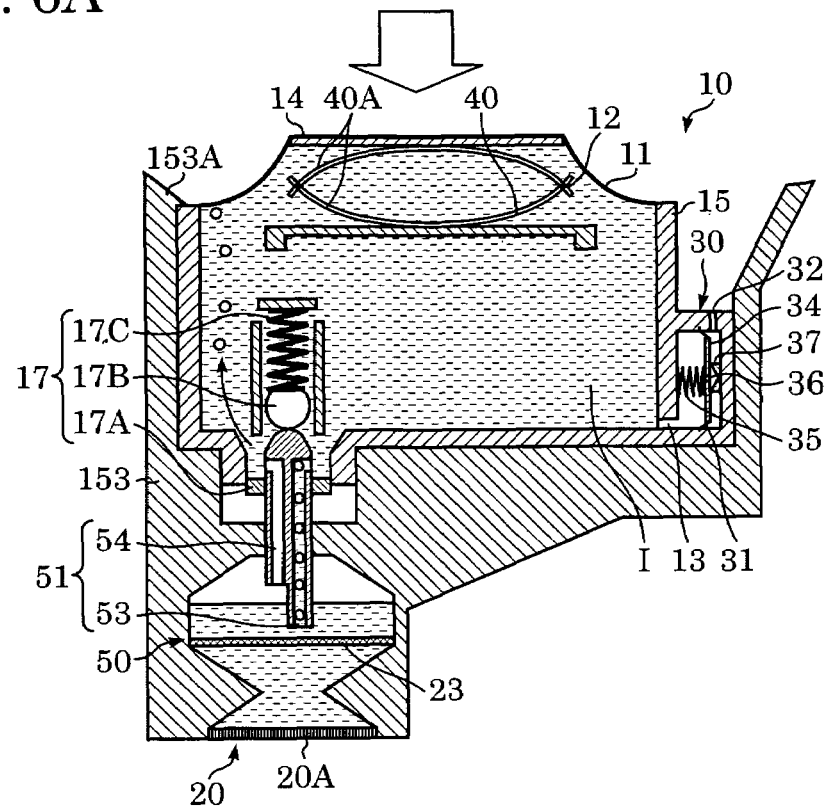
FIGS. 6A and 6B are schematic sectional views of the liquid-feeding system for illustrating operations thereof, respectively in a state in which the multiple meniscus state in an ink flow path and in the air flow path is not resolved.
Figure 6B:
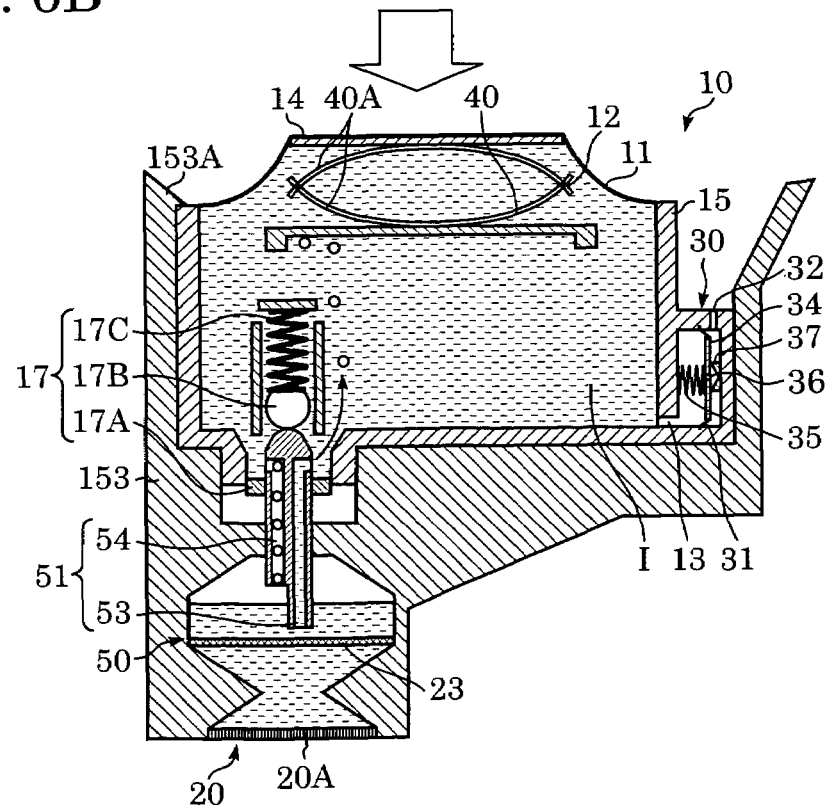

Referring to FIGS. 6A and 6B, the case where the air flow path 54 or the ink flow path 53 has a smaller pressure resistance as described above will be discussed.

FIG. 6A illustrates an operation of the connecting portion when the new ink tank 10 is placed with the air flow path 54 having a smaller pressure resistance. Just after the placement, since at least one part of the air in the area upstream of the filter 23 is introduced into the ink-storing chamber 12 through the air flow path 54, the multiple meniscus state in the air flow path 54 is resolved with a negative pressure in the ink-storing chamber 12. On the contrary, the ink flow path 53 remains in the multiple meniscus state. In other words, in this state, ink is consumed by the recording head 20.

As ink consumption by the recording head 20 continues, since the opening close to the head, of the ink flow path 53, lies in contact with ink in the liquid chamber 50, a negative pressure is generated in the liquid chamber 50 in accordance with the ink consumption. Although the ink flow path 53 has an increased pressure resistance, it matters little about ink movement, allowing ink to be fed from the ink-storing chamber 12. Accordingly, the multiple meniscus state of the ink flow path 53 will be eventually resolved. Also, even when air other than that moved just after the placement of the ink tank remains, when ink is consumed in the initial state after the placement of the ink tank as described above, the gas-liquid exchange is produced, and thus, the whole remaining gas is transferred to the ink tank.

FIG. 6B illustrates a state in which the new ink tank 10 is placed with the ink flow path 53 having a smaller pressure resistance. Just after the placement of the ink tank, the negative pressure in the ink-storing chamber 12 causes fluids (ink and air) to be drawn into the ink-storing chamber 12 through the ink flow path 53, and the multiple meniscus state in the ink flow path 53 is hence resolved; however, the multiple meniscus state in the air flow path 54 remains unresolved.

When ink consumption of the recording head 20 continues in this state, although a negative pressure is generated in the liquid chamber 50, the negative pressure is curbed since ink is fed to the liquid chamber 50 from the ink-storing chamber 12. On this occasion, the ink fed from the ink-storing chamber 12 passes through the ink flow path 53 having a smaller pressure resistance. From now on, since ink is fed to the recording head 20 while a rise in negative pressure in the liquid chamber in accordance with ink consumption and ink introduction from the ink tank 10 to the recording head 20 through the ink path 53 in accordance with the negative pressure rise take place repetitively, air and ink pass through the air flow path 54 only after ink in the ink-storing chamber 12 is used up. In other words, when the ink tank is in use, the multiple meniscus state in the air flow path 54 having a greater pressure resistance is not resolved, whereby air stays in the area upstream of the filter 23.

Thus, accordingly to the present invention, the multiple meniscus state in the air flow path as described above is especially resolved, and the above-described basic gas-liquid exchange is reliably performed, thereby achieving smoother and quicker transfer of residual air.

Referring to FIGS. 7 to 11, a process of removing bubbles to the ink tank in the structure of the liquid-feeding system shown in FIG. 1 according to the present embodiment will be described in detail.

Figure 7:
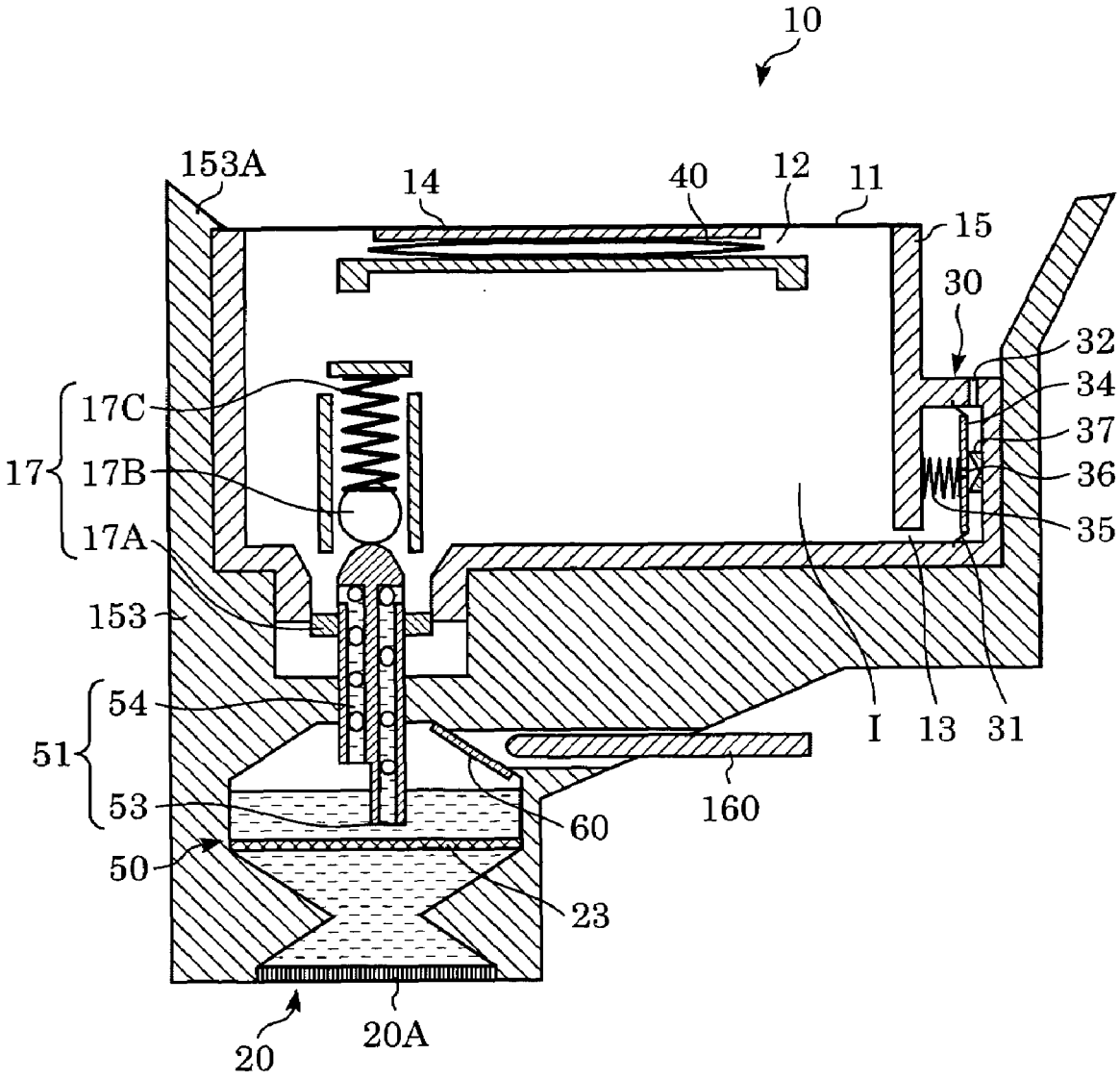
FIG. 7 is a schematic sectional view of the liquid-feeding system in a state in which ink in the ink tank is completely used up, and the inside of a communication path is in the multiple meniscus state.

FIG. 7 illustrates a state in which ink in the ink tank 10 is completely used up. In this state, although the spring member 40 is mostly deformed, the air pressure in the ink tank 10 is controlled by action of the valve chamber 30 serving as an one-way valve so as to be lower than the atmospheric pressure by an amount determined by the spring member 35 and the pressure plate 34 in the valve chamber. Also, since the recording operation of the recording head has been performed even when the ink tank 10 nearly runs out of ink, in the ink consumption process, air is drawn into the liquid chamber 50 from the ink tank 10, thereby causing both ink and air flow paths 53 and 54 to fall in the multiple meniscus state.

Figure 8:
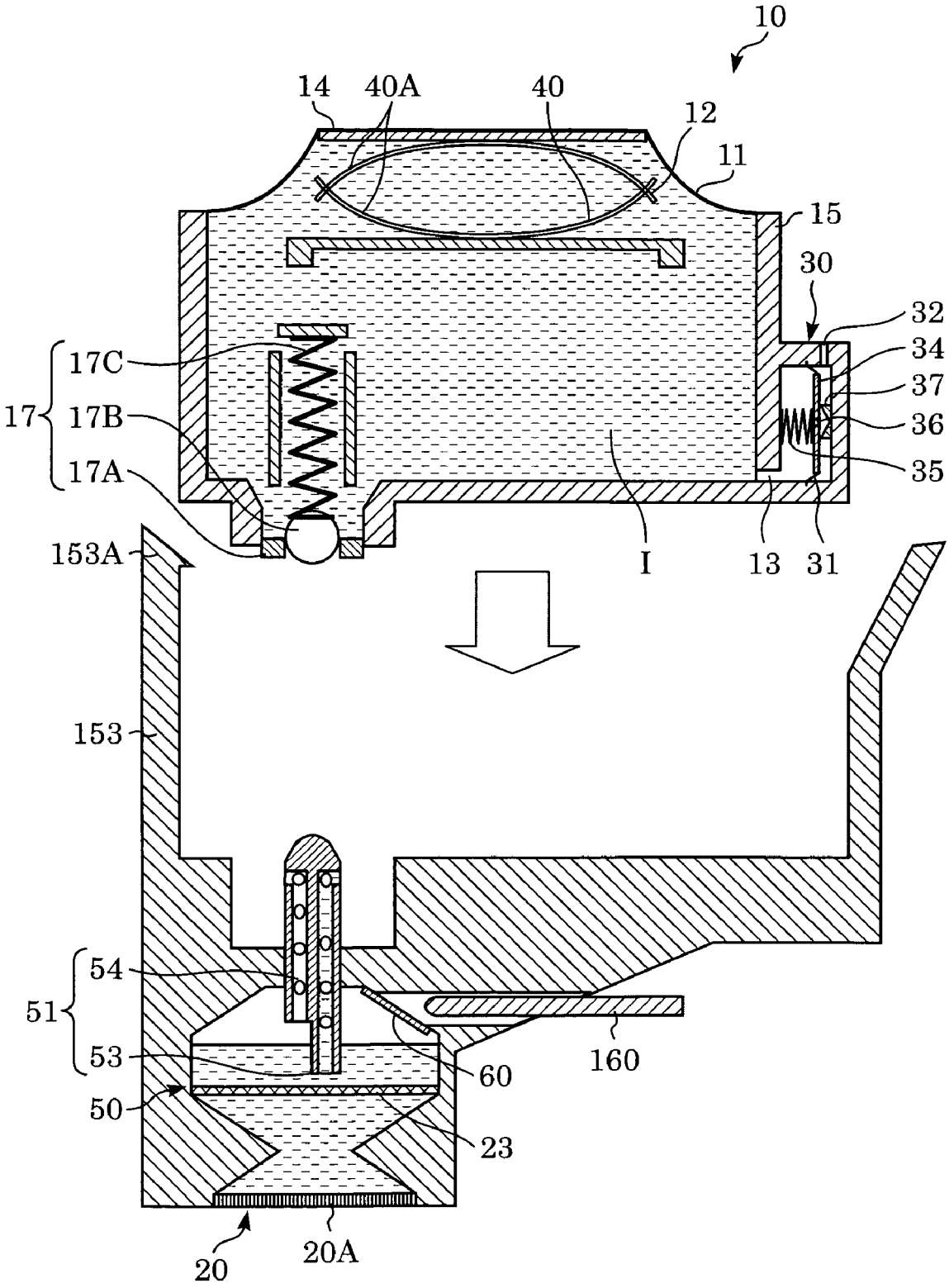
FIG. 8 is a schematic sectional view of the liquid-feeding system in a state in which a new ink tank is has not placed in the liquid chamber or on the recording head.

FIG. 8 illustrates a state in which the empty ink tank has been removed and a new ink tank 10 is about to be placed. In this state, the ink tank 10 is completely filled with ink I, a negative pressure is generated in the ink tank by the spring member 40, and also the sheet member 11 protrudes outside the ink tank.

Figure 9:
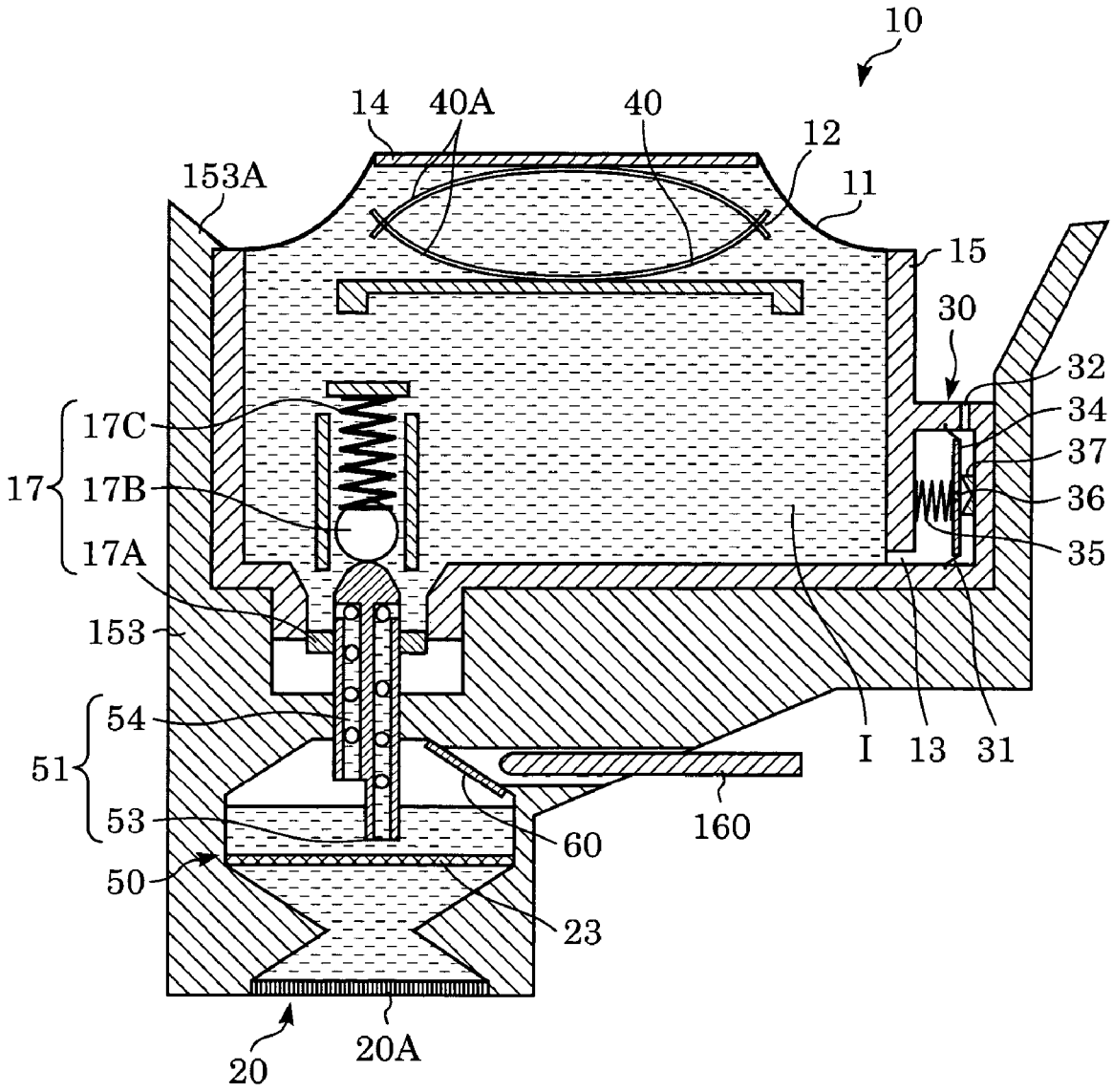
FIG. 9 is a schematic sectional view of the liquid-feeding system showing a new ink tank prior to being placed in the state shown in FIG. 8.

FIG. 9 illustrates a state in which the new ink tank 10 has been just placed in the state shown in FIG. 8. Since the recording head 20 or the liquid chamber 50 is not open to the atmosphere in the state shown in FIG. 8, the air pressure in the area upstream of the filter 23 is equal to the atmospheric pressure. On the contrary, the internal pressure of the ink tank 10 is negative, that is, lower than the atmospheric pressure, caused by the spring member 40. With this arrangement, just after the ink tank 10 is placed, the multiple meniscus state in the flow path having a smaller number of meniscuses, that is, a smaller pressure resistance as described above is resolved. Since the air flow path 54 has a greater pressure resistance, although the multiple meniscus state in the ink flow path 53 is resolved, the multiple meniscus state in the air flow path 54 is not resolved, thereby resulting in the problematic state shown in FIG. 5.

Figure 10:
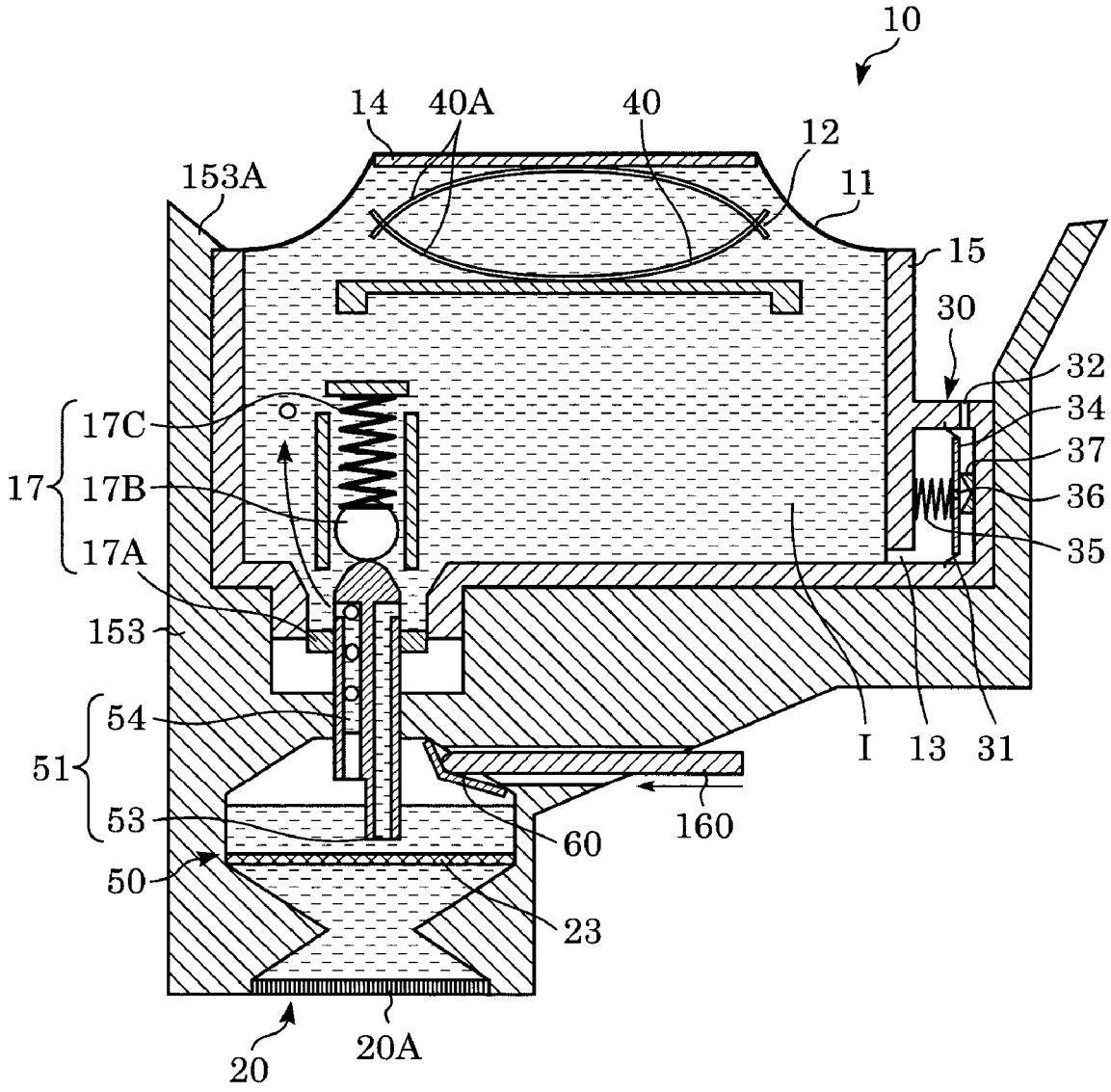
FIG. 10 is a schematic sectional view of the liquid-feeding system in a state in which a pressure-changing means is activated in the state shown in FIG. 9, and bubbles in the air flow path are removed.

On the contrary, according to the present embodiment, by increasing the internal pressure of the liquid chamber 50 by activating the pressure-changing means, the multiple meniscus state in the air flow path 54 is resolved. That is, the inkjet recording apparatus according to the present embodiment has the pressing member 160 and the elastic wall 60 disposed therein, serving as components of the pressure-changing means, and, as shown in FIG. 10, the elastic wall 60 is deformed toward the inside of the liquid chamber 50 by the pressing member 160 so as to reduce the internal volume of the liquid chamber 50 and resultantly to pressurize the liquid chamber 50. Thus, the multiple meniscus state in the air flow path 54 pressurized as described above is resolved.

Although the theory concerning the relationship among pressures will be described later, when the air flow path is pressurized as described above, meniscuses formed in the opening close to the head, of the air flow path 54 are also pressurized. When the pressure exerted on the meniscuses becomes greater than a pressure resistance due to the multiple meniscuses, the multiple meniscus state is resolved, pressurized residual air in the liquid chamber 50 moves to the ink-storing chamber 12 through the air flow path 54, and this movement causes ink and air forming the multiple meniscus state to be ejected to the ink-storing chamber 12.

Figure 11:
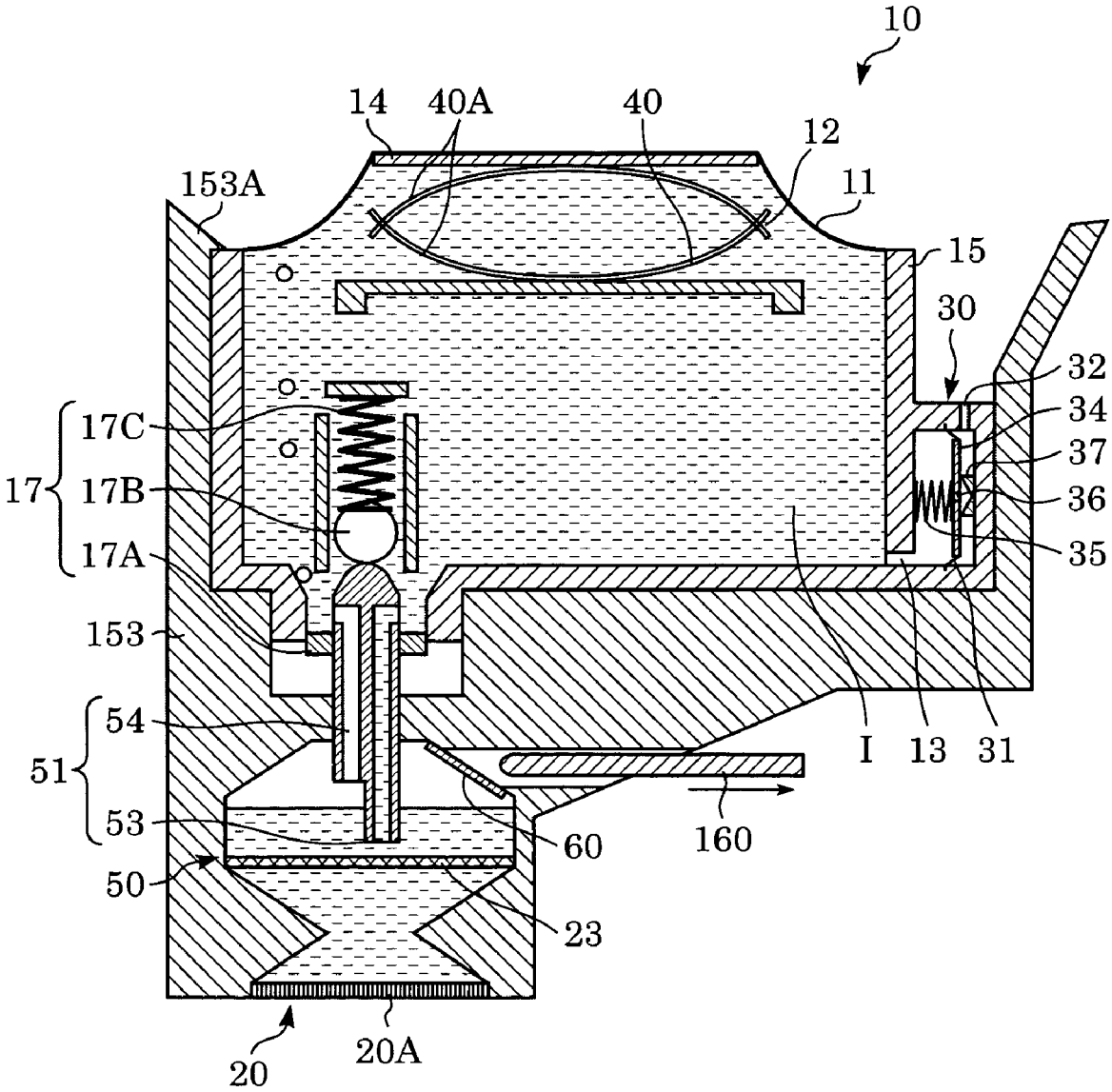
FIG. 11 is a schematic sectional view of the liquid-feeding system in a state in which the pressure-changing means has been activated, and no bubbles exist in the air flow path.

FIG. 11 illustrates a state in which the multiple meniscus state in the air flow path 54 has been resolved. When the meniscus state is resolved, the above-described basic gas-liquid exchange is reliably performed, and in addition, ink starts to be excellently fed to the recording head 20. Also, in this state, the pressing member 160 returns to home position on the right side in FIG. 11, and the elastic wall 60 also restores its original shape.

Meanwhile, in order to prevent the elastic wall 60 from following fluctuations in pressure repeated in the liquid chamber 50 and from being deformed due to the fluctuations, it is strongly desired that the elastic wall 60 has a material strength as large as not to be deformed due to a negative pressure level in the liquid chamber 50, achieved by the normal ink feeding operation.

Figure 12:
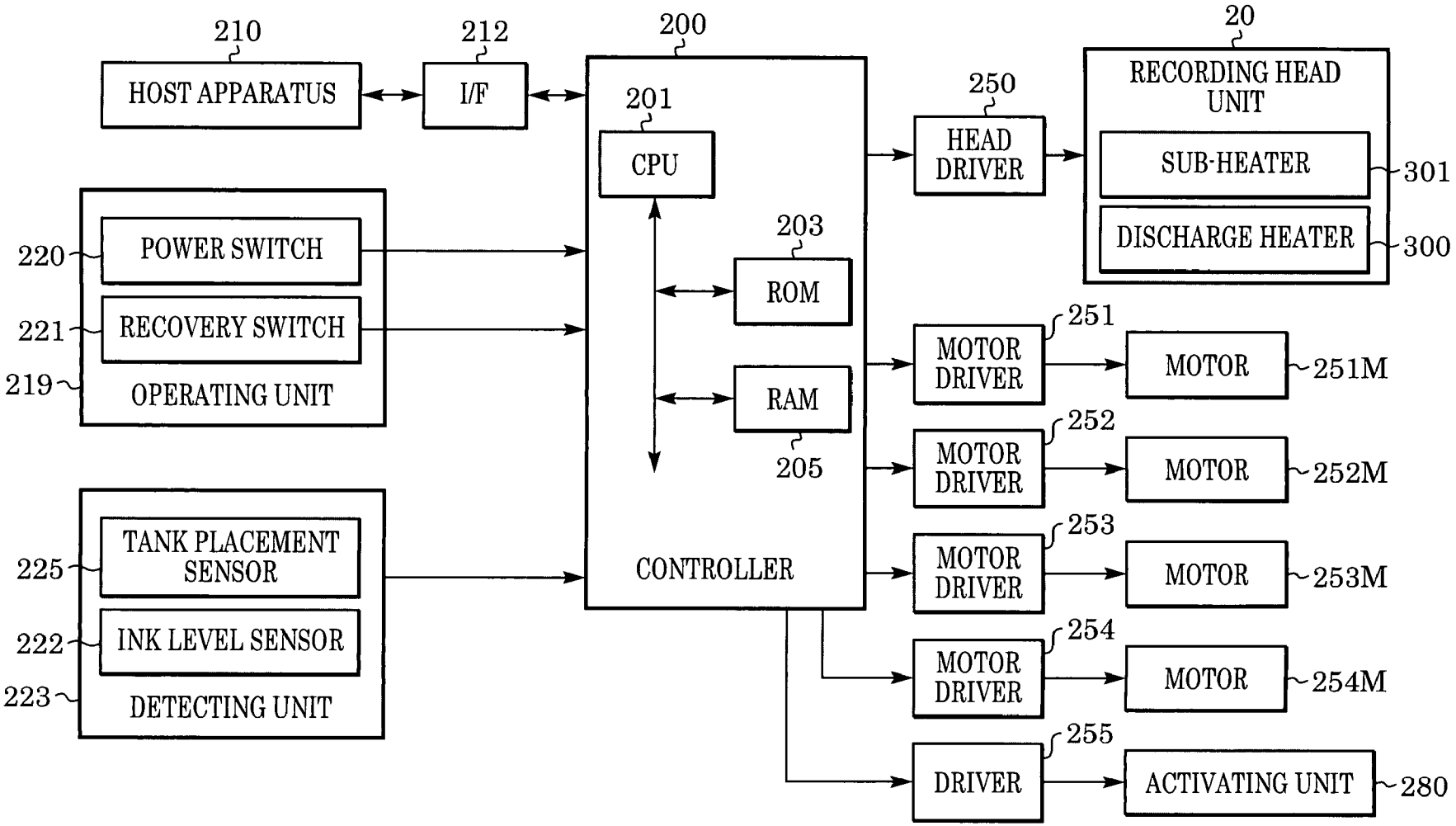
FIG. 12 is a block diagram illustrating a recording-apparatus control system applicable to the first embodiment.
Figure 13:
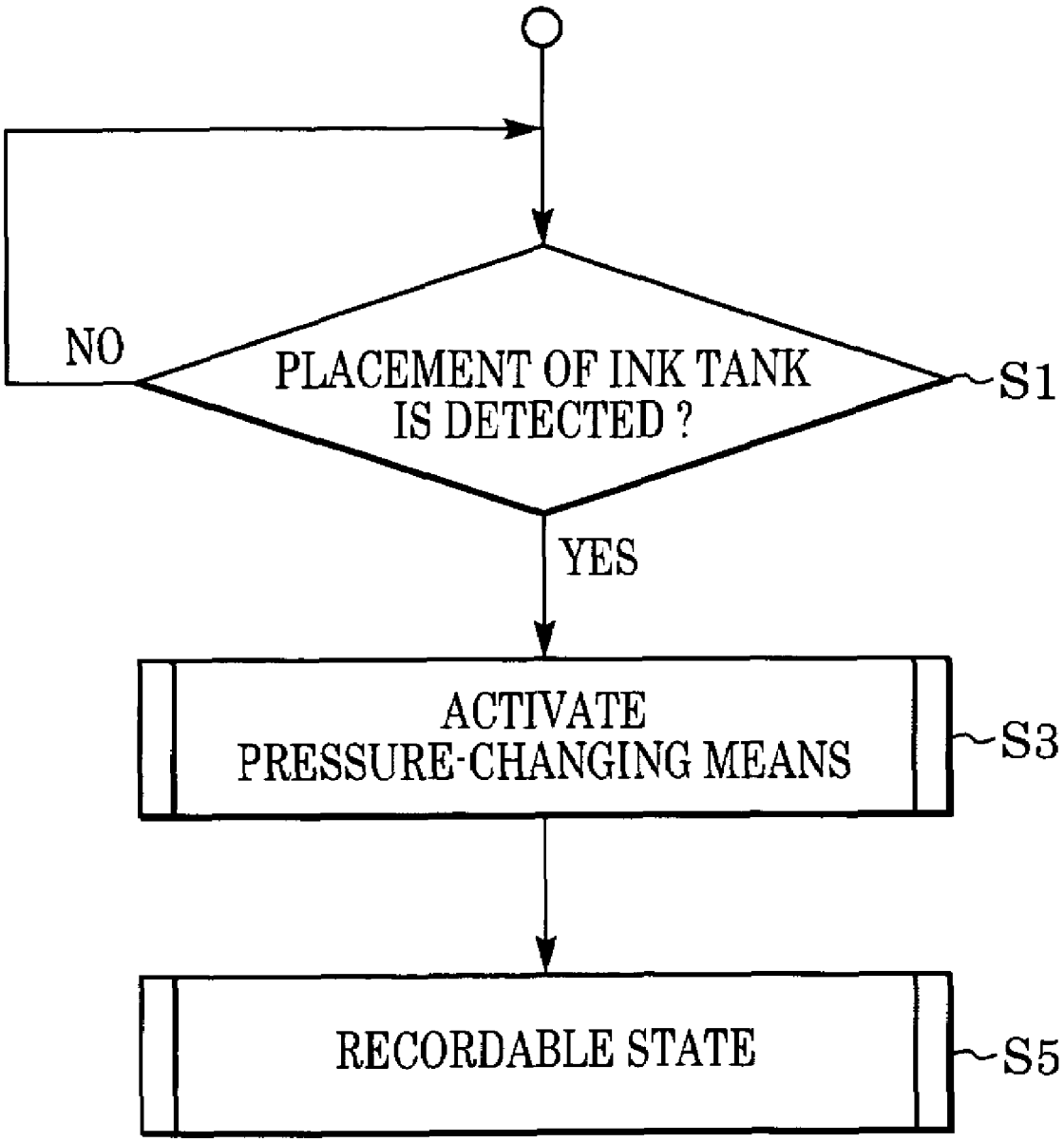
FIG. 13 is a flowchart illustrating an example control procedure of the pressure-changing means in accordance with the structure shown in FIG. 12.

FIG. 12 illustrates an example control system of the recording apparatus, including an activating unit (activating means) of the pressure-changing means, and FIG. 13 illustrates an example control procedure for activating the pressure-changing means.

The control system shown in FIG. 12 is applicable to the structure of an inkjet recording apparatus shown in FIG. 19, which will be described later. In the figure, a controller 200 acts as a main control unit and includes, for example, a CPU 201 in a form of a microcomputer; a ROM 203 storing a program, a necessary table, and other fixed data; and a RAM 205 having an area for extracting image data, a working area, and the like disposed therein. A host apparatus 210 is a source of supply of the image data and may be in a form of a reading unit for reading the image data, a digital camera, or the like, other than a computer for producing and processing data such as an image for printing.

The host apparatus 210 transmits/receives the image data, a command, a status signal, and the like to and from the controller 200 via an interface (I/F) 212. An operating unit 219 includes a group of switches for accepting instruction inputs of an operator, such as a power switch 220, and a recovery switch 221 for instructing start of suction recovery. A detecting unit 223 includes a group of sensors such as a sensor 225 for detecting placement of the ink tank 10, and level sensor 222 for detecting an ink level and prompting an operator to replace the ink tank 10 with a new one, and sensors for detecting predetermined status of the recording apparatus.

A head driver 250 drives an electrothermal conversion member (discharge heater) 300 of the recording head 20 in response to print data or the like. Also, the recording head 20 has a temperature-regulating sub-heater 301 disposed therein, for stabilizing the ink-discharging characteristics of the apparatus. The sub-heater 301 may be formed on a print head substrate together with the discharge heater 300, or fixed to the main body of the recording head or the liquid chamber 50.

Motor drivers 251, 252, 253, and 254 respectively drive a main scanning motor 251M as a drive source of the carriage 153, a line feed (LF) motor 252M as a drive source for transporting a recording medium, a paper-feeding motor 253M as a drive source for feeding a recording medium, and a motor 254M for driving a recovery system.

An activating unit 280 includes the pressing member 160, and a driver 255 drives the activating unit 280. The activating means may be in a form of a solenoid including an actuator, for example, protruding/retracting in response to energization/non-energization. Also, the actuator or a member combined therewith may be used as the pressing member 160.

With the above-described structure, in order to resolve the multiple meniscus state before start of recording, as shown in FIG. 13, when placement of the ink tank 10 is detected (in Step S1), the pressure-changing means is activated (in Step S3). That is, by energizing the pressing means in a form of, for example, solenoid, the actuator is protruded so as to displace the pressing member 160 and thus to deform the elastic wall 60. With this process, the multiple meniscus state is resolved, then activation of the pressing means is removed, and a recordable state is thus established (in Step S5). It is possible to notify the host apparatus of this state via the interface 212.

Although the pressure-changing means is controlled with software in the above-described control system, it may be controlled with hardware activating the pressure-changing means in conjunction with the sensor detecting placement of the ink tank or one of the switches. Alternatively, by connecting an upper part of the carriage 153, on which the ink tank is placed, and the pressing member 160 with an appropriate link mechanism, the pressing member 160 may be displaced or returned to its home position in accordance with a displacement operation of the ink tank. Further alternatively, the pressing member 160 may be constructed so as to be activated directly by hand. In this case, the liquid-feeding system may include a movement-range-regulating member preventing the pressing member 160 from dropping or damaging the elastic wall when pressed more than necessary. Also, since the pressing member 160 is retracted in accordance with recovery of the elastic wall 60 when the manual pressing operation is removed, the liquid-feeding system may additionally include a recovery spring of the pressing member 160 in order to help the above-mentioned retraction.

Subsequently, the principle of an operation of gas-liquid exchange will be described.

Figure 14:
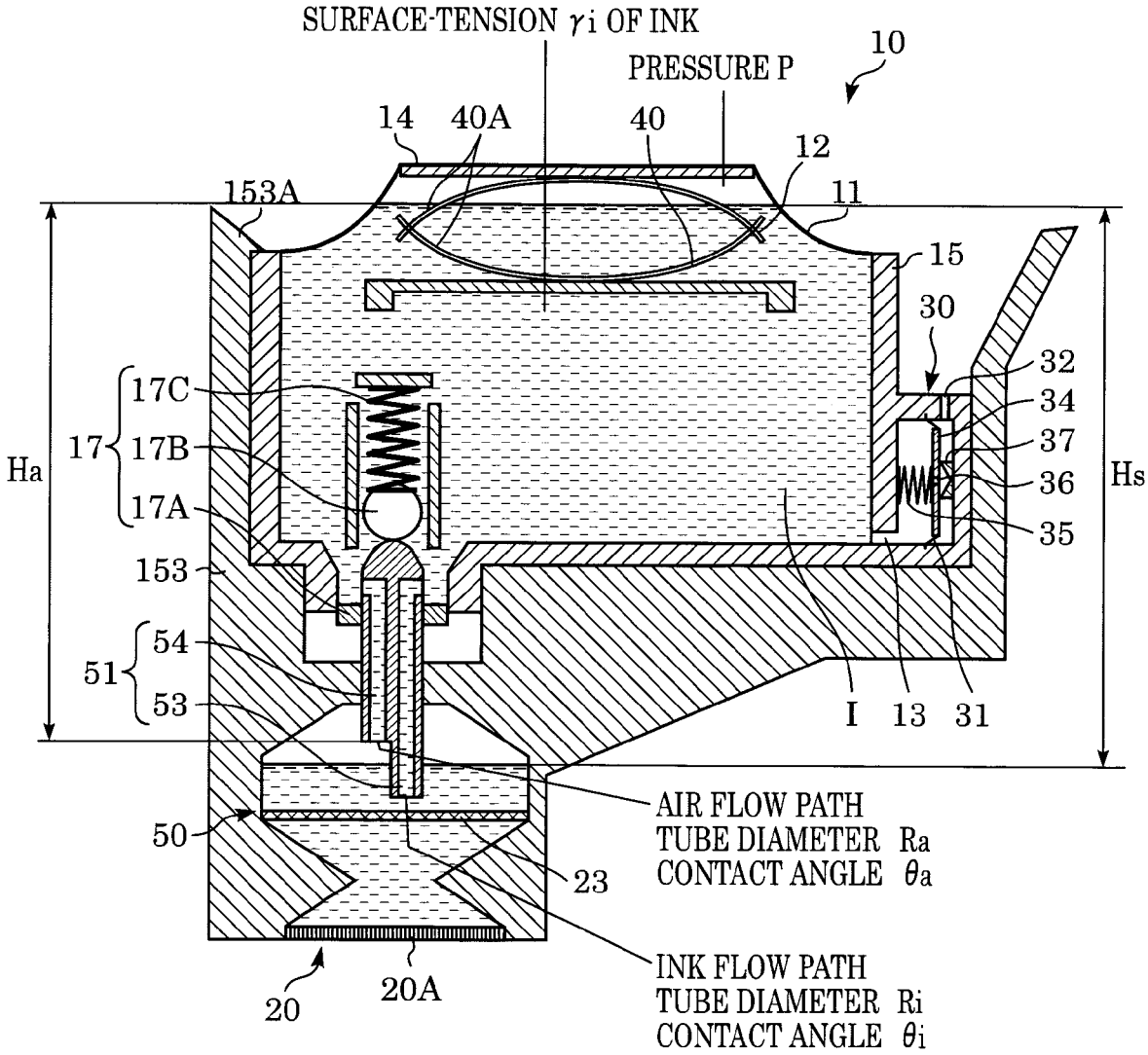
FIG. 14 illustrates the basic principle of ink movement and gas ejection in the liquid-feeding system according to the first embodiment.

Referring now to FIG. 14, a pressure balance at every part will be described. Although FIG. 14 illustrates a state in which a negative pressure in the liquid chamber is generated in accordance with ink consumption in the initial state after placement of the ink tank and each flow path is filled with ink and in which the basic gas-liquid exchange is to be started, for the sake of explanation, it is tentatively assumed that this state remains unchanged.

A pressure of air staying in the area upstream of the filter 23 will be discussed. When a pressure of bubbles in the ink-storing chamber 12, a pressure due to the head between the ink-air interface of ink in the ink-storing chamber 12 and in the area upstream of the filter 23 are respectively represented by P and Hs, the pressure of air in the area upstream of the filter 23 is (P+Hs) greater than the pressure of the air in the ink-storing chamber 12 by Hs. This pressure increase is caused by the enclosed structure of the liquid chamber 50 or the recording head 20 and is not caused by the structures as disclosed in the foregoing related arts (for example, Japanese Patent Laid-Open No. 5-96744) in which the ink tank 10 and the recording head 20 have an atmosphere communication port disposed therebetween.

Next, a pressure balance at a meniscus position in the opening of the air flow path 54 close to the head will be described. When a pressure due to the head between the ink-air interface of ink in the ink-storing chamber 12 and in the opening of the air flow path 54 close to the head is represented by Ha, a downward pressure and an upward pressure exerted on the meniscus position are (P+Ha) and (the above-mentioned air pressure P+Hs), respectively. Since it is assumed that the pressure balance is established in this state, a difference in these pressures in the vertical direction balances with a pressure Ma caused by meniscuses and represented by the expression (1):

$$Ma=2\gamma i\times\cos\theta a/Ra \quad (1),$$

where γi is a surface tension of ink, θa is a contact angle of ink with the air flow path 54, Ra is a tube diameter (internal diameter) of the air flow path 54.

Accordingly, the pressure balance at the opening of the air flow path 54 close to the head is represented by the following expression:

$$P+Hs-(P+Ha)=Ma \quad (2), \text{ or}$$

$$Hs-Ha=Ma \quad (3)$$

In other words, the pressure due to the head between the meniscus position of the air flow path 54 and the ink-air interface in the area upstream of the filter 23 balances with the pressure caused by meniscuses in the air flow path 54. When the volume of gas remaining in the area upstream of the filter becomes greater, and the expression (4) is satisfied:

$$Hs-Ha>Ma \quad (4),$$

since a pressure of the gas in the area upstream of the filter is high, the meniscuses in the air flow path 54 start to move toward the ink-storing chamber 12; thus air moves toward the ink-storing chamber 12. Also, in accordance with this movement, ink in the ink-storing chamber 12 moves into the liquid chamber 50 through the ink flow path 53, thereby causing the ink level in the liquid chamber to rise.

Since the volume of the air flow path 54 is very much smaller than that of the liquid chamber, in the initial state in which the air starts to move, the meniscus position of the air flow path 54 moves quickly toward the opening of the same close to the ink tank while the ink level in the liquid chamber 50 having a relative larger volume does not rise so much. As a result, the pressure (Hs−Ha) due to the head between the opening of the air flow path 54 close to the ink tank and the ink-air interface of in the area upstream of the filter 23 (Hs−Ha) becomes substantially greater than the pressure due to the meniscuses in the air flow path 54, thereby prompting air ejection.

In the state in which the air is introduced into the ink tank, the meniscus position in the air flow path 54 lies at the opening of the air flow path close to the ink tank. Air is allowed to move as long as the expression (5) is satisfied, while the movement stops upon the expression (6) being satisfied before the air-ink interface in the area upstream of the filter reaches the opening of the air flow path close to the head:

$$Hs-Ha'>Ma' \quad (5), \text{ and}$$

$$Hs-Ha'<Ma'. \quad (6)$$

where Ha' and Ma' are respectively a pressure at the opening close to the ink tank, due to the head between the opening and the air-ink interface in the ink-storing chamber 12 and a meniscus pressure (generated at the opening of the air flow path close to the ink tank).

In the meantime, when the air-ink interface in the area upstream of the filter reaches the opening of the air flow, close to the head, with the expression (5) being satisfied, since the meniscus pressure generated at the opening of the air flow close to the head is also involved in the pressure balance, the air movement stops when the expression (7) is satisfied:

$$La<Ma+Ma' \quad (7),$$

where La is a pressure equivalent to the head between liquid levels of ink, corresponding to the length of the air flow path.

When the expression (8) is satisfied, the air movement does not stop, and the air-ink interface further rises in the air flow path:

$$La>Ma+Ma' \quad (8)$$

When the air-ink interface is moving in the air flow path, air is allowed to move as long as the expression (9) is satisfied:

$$Hs'-Ha'>Ma'+Ms' \quad (9),$$

where Hs' is a pressure corresponding to the head between the air-ink interface in the air flow path and the air-ink interface in the ink tank, and Ms' is a dynamic meniscus pressure generated at the air-ink interface in the air flow path. Meanwhile, since contact angles of ink with the air flow path in dynamic and static states are different from each other, the meniscus pressure Ma considered at the time of starting the air movement and the dynamic meniscus pressure Ms' are different from each other even when the tube diameter is identical, and Ma is greater than Ms'.

Next, a pressure resistance in the multiple meniscus state will be described. In this description, a theoretical explanation of a pressure increment due to the multiple meniscus state will be provided.

A pressure resistance caused by multiple meniscuses is determined by the fact that a force due to a plurality of meniscuses generated by individual bubbles is in proportion to the number of the bubbles meniscus. In other words, a pressure resistance due to multiple meniscuses is represented by the product of a meniscus force due to a single bubble and the number of bubbles. Hence, a meniscus force (M) due to a single bubble will be first computed, and a pressure resistance in the multiple meniscus state will be then computed.

Figure 15:
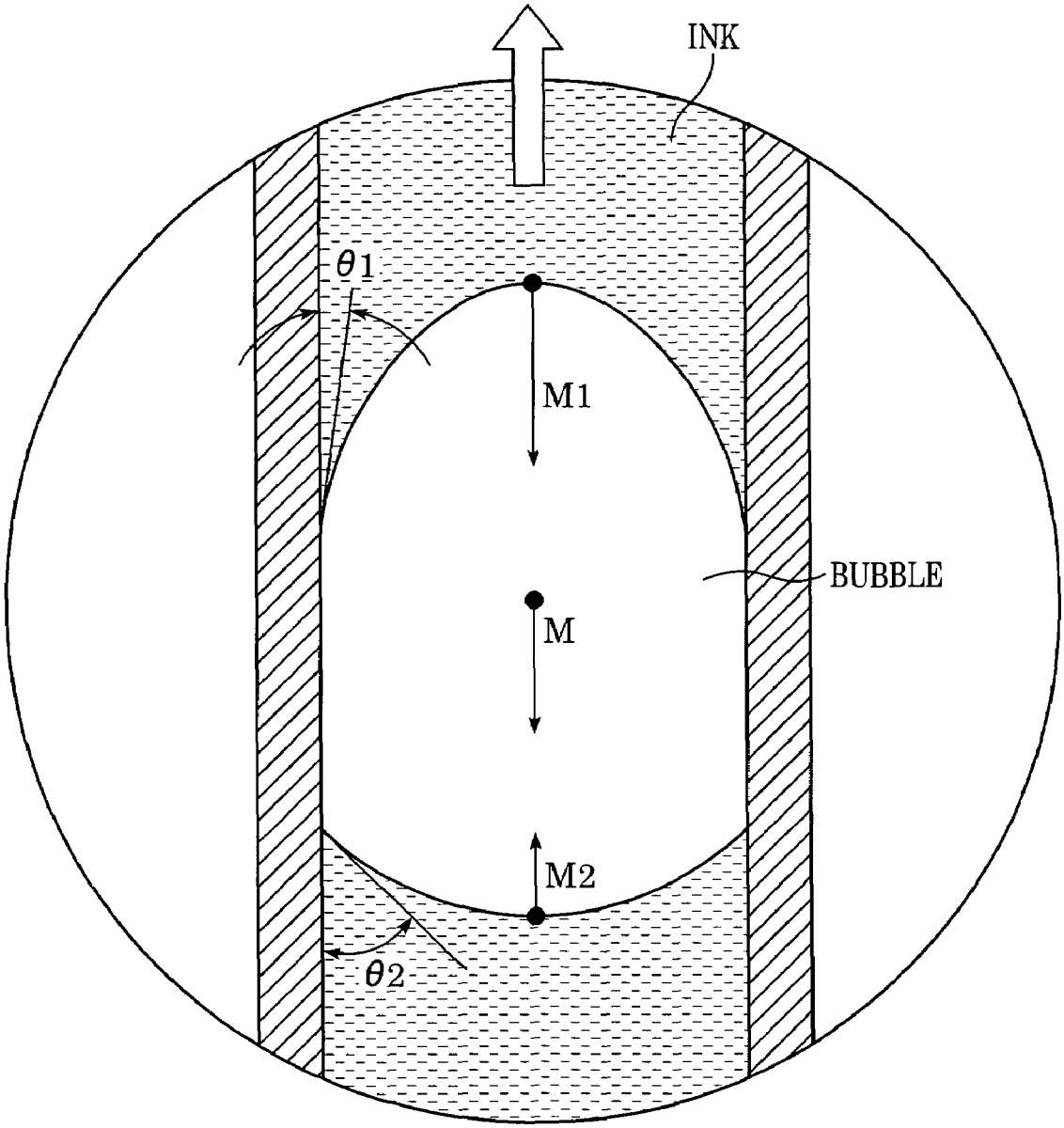
FIG. 15 illustrates meniscus forces of a single bubble existing in a flow path.

FIG. 15 illustrates a state in which a single bubble staying in a flow path is about to move upwards (in the direction indicated by the arrow in the figure). A meniscus force due to the single bubble is represented by M, meniscus forces generated on the upper and lower interfaces of the bubble are respectively represented by M1 and M2, and contact angles of the upper and lower interfaces of the bubble with the flow path are respectively represented by θ1 and θ2. Since the single bubble shown in FIG. 15 is about to move upward, the upper contact angle θ1 is a swept-back contact angle, and the lower contact angle θ2 is a swept-forward contact angle.

A contact angle between ink and a flow path will be now described. The contact angle is generally determined by a surface tension γi of ink, a surface tension γb of a member making up the flow path, and an interfacial tension γib between the ink and the flow path and is computed by the following expression:

$$\gamma b=\gamma i\times\cos\theta+\gamma ib \quad (10)$$

When a possibility that a variety of ink types from dye-base ink having a low surface tension to pigment-base ink having a high surface tension are used in an ink-jet recording apparatus is taken into account, and also when the case where the flow path is composed of a non-water-repellant metal is taken into account, a range of the contact angle, that is, ranges of the swept-forward contact angle and the swept-back contact angle can be set as given by the following expression:

$$5^\circ \text{ (swept-back contact angle)}<\theta<60^\circ \text{ (swept-forward contact angle)} \quad (11).$$

Accordingly, since a range of contact angles between ink and non-water-repellant metal is smaller than 90°, it can be understood that each of meniscuses formed on the upper and lower interfaces of a bubble has a shape protruding outward of the bubble as shown in FIG. 15. Also, directions of forces of the meniscuses formed on the upper and lower interfaces of the bubble can be determined. Resultantly, it can be also understood that the meniscus forces on the upper and lower interfaces are directed inwards of the bubble so as to cancel each other as shown in FIG. 15.

Next, computation of a meniscus force M of a single bubble will be described. As described above, since the meniscus forces formed on the upper and lower interfaces of the single bubble are directed so as to cancel each other, the meniscus force M is represented by the expression (12) by using the expression (1):

$$M=2\gamma i\times\cos\theta 1/Ra-2\gamma i\times\cos\theta 2/Ra \quad (12).$$

As described above, since the multiple meniscus state is represented by a meniscus force due to a single bubble and the number of bubbles, when the number of bubbles generated in the air flow path 54 is represented by n, a pressure resistance ΔPr due to multiple meniscuses is represented by the following expression:

$$\Delta Pr=n(2\gamma i\times\cos\theta 1/Ra-2\gamma i\times\cos\theta 2/Ra) \quad (13) \text{ or}$$

$$\Delta Pr=2n\times\gamma i/Ra\times(\cos\theta 1-\cos\theta 2) \quad (13').$$

In other words, the pressure resistance given by the expression (13') is added to the right side of the expression (4).

Figure 16:
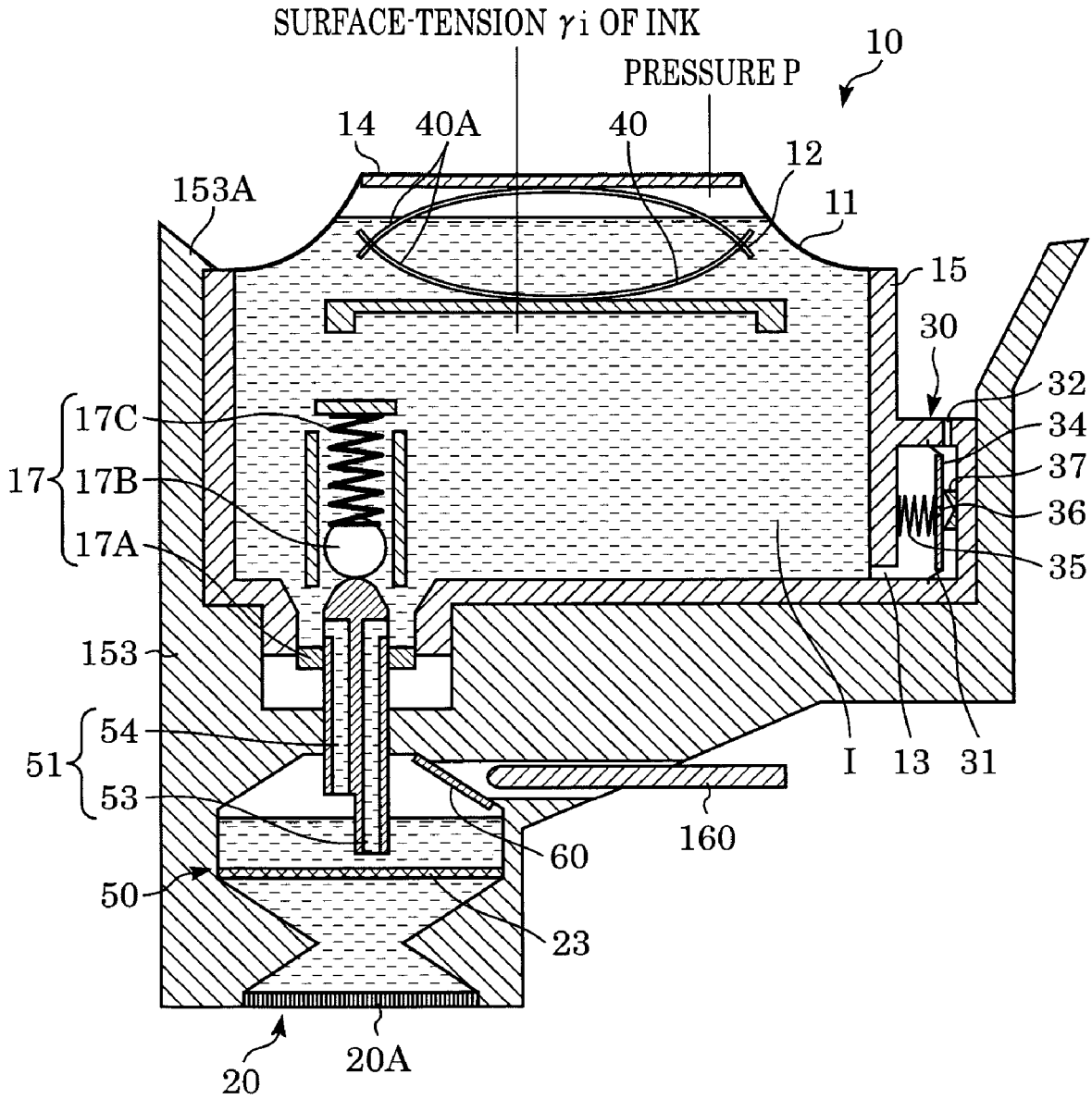
FIG. 16 illustrates a pressure increment due to activation of a pressing member engaged in ink movement and gas ejection in the liquid-feeding system according to the first embodiment.

Referring next to FIG. 16, a pressure increment in the liquid chamber 50 due to a pressing operation of the pressing member 160 serving as the pressure-changing means in the first embodiment will be described.

The internal volume and the internal pressure of the liquid chamber before pressing the elastic wall 60 are respectively represented by Vh and Ph, and those after pressing the elastic wall 60 are respectively represented by Vh' and Ph'. Since the liquid chamber is enclosed, when it is assumed that the pressing of the elastic wall does not causes a variance in temperature in the liquid chamber, the following expression is obtained on the basis of the Boyle-Charles law:

$$Ph\times Vh=Ph'\times Vh'(Vh>Vh') \quad (14) \text{ or}$$

$$Ph'=(Vh/Vh')\times Ph \quad (14').$$

A pressure increment ΔPh of the internal pressure of the liquid chamber 50 is given by the following expression:

$$\Delta Ph=(Vh/Vh')\times Ph-Ph \quad (15) \text{ or}$$

$$\Delta Ph=(Vh/Vh'-1)Ph \quad (15').$$

Thus, since the condition for resolving the multiple meniscus state is such that ΔPh given by the expression (15') is greater than ΔPr given by the expression (13), the condition is represented in an organized form as below:

$$Vh'<Ph\times Ra\times Vh/(2\gamma i\times n(\cos\theta 1-\cos\theta 2)+Ph\times Ra) \quad (16).$$

As a result, upon pressing the elastic wall 60 in the liquid chamber 50 by the pressing member 16 which is a feature of the present embodiment, by deforming the internal space (by reducing the internal volume) of the liquid chamber 50 so as to satisfy the expression (16), the multiple meniscus state is resolved, and air is accordingly ejected to the ink-storing chamber 12.

Second Embodiment

Figure 17:
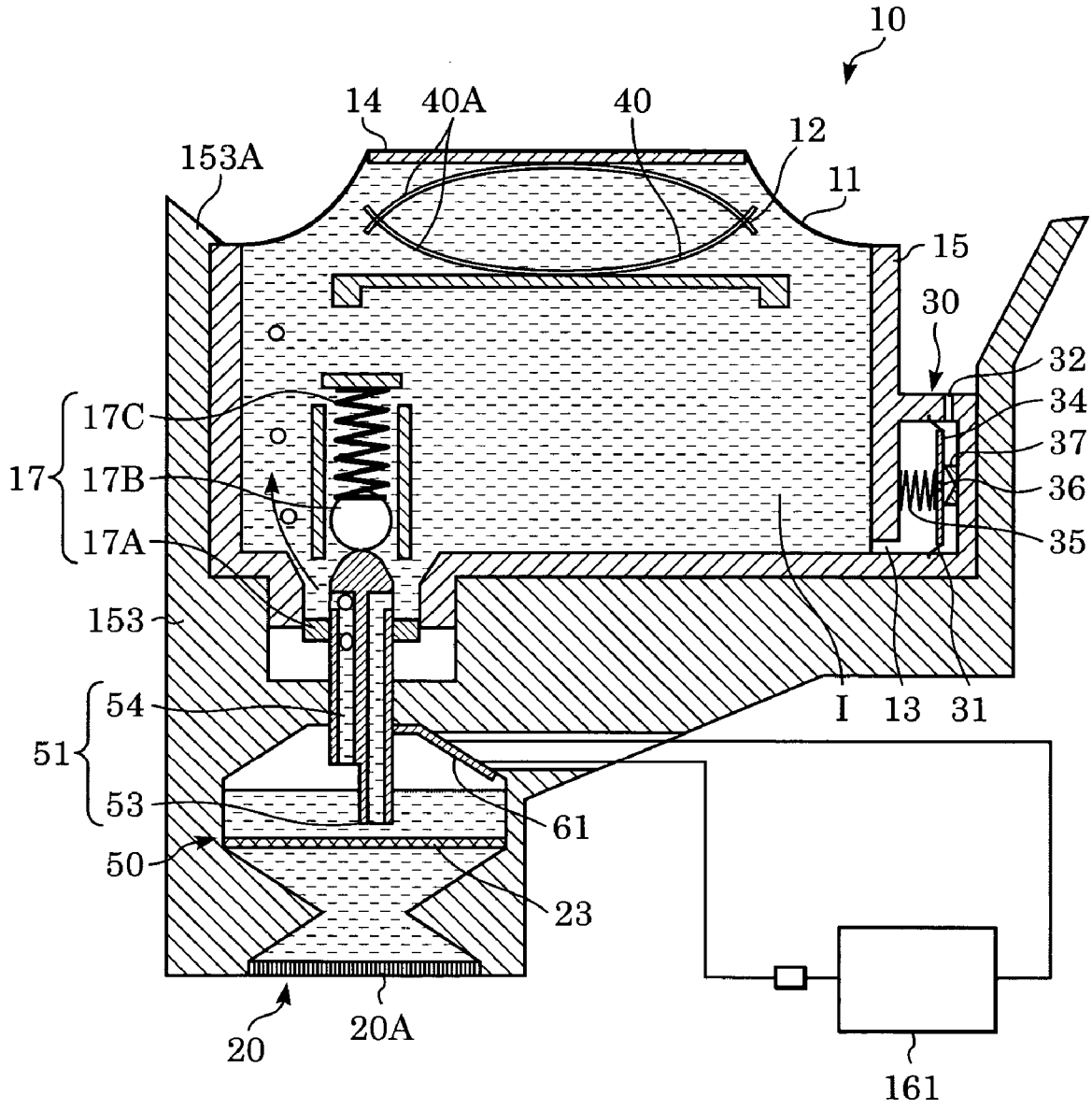
FIG. 17 is a schematic sectional view illustrating the structure of a liquid-feeding system according to a second embodiment of the present invention and the principle of gas ejection in the system.

Referring to FIG. 17, the structure and an operation of an ink-feeding system according to a second embodiment will be described. The same parts as in the first embodiment are identified by the same reference characters as in the first embodiment.

Although the pressing member 160 and the elastic wall 60 make up the pressure-changing means in the first embodiment, it is made up by a power unit 161 and an electric resistor (heater) 61 in the present embodiment. The multiple meniscus state is resolved also in the present embodiment by increasing the internal pressure of the liquid chamber 50 in the same fashion as in the first embodiment. That is, the internal pressure is increased by heating air in the area upstream of the filter 23 existing in the liquid chamber 50, with the electric resistor 61, so as to cause the temperature of the air to increase.

In the same fashion as in the first embodiment, as shown FIG. 13, after placement of the ink tank 10, the power unit 161 making up the pressure-changing means is controlled so as to energize and thus to heat the electric resistor 61, and the multiple meniscus state is thus resolved before the recordable state is established.

In the present embodiment, since being intended to increase the internal pressure of the liquid chamber 50 by heating air in the same, the electric resistor 61 is disposed on the upper wall of the liquid chamber 50 so as to be in direct contact with gas. However, the electric resistor is not limited to the above structure. Even when disposed in a state of being always in contact with ink, it works as long as it can generate heat being appropriately transferred to the air through the ink.

Although the electric resistor 61 may be specially disposed as an exclusive component, instead of this, when means for regulating the temperature of ink in the recording head 20 at an appropriate value is also used as the electric resistor 61, the same effect can be obtained. Such means includes a warming heater (sub-heater) disposed on the recording head. Also, in a recording head including an electrothermal conversion member (discharge heater) generating thermal energy for discharging ink, a component driving (preliminarily heating) the discharge heater so as to generate heat as much as not to cause ink to be discharged may be applied. With these structures, no special means is needed, thereby preventing the recording apparatus from having a complicated structure.

Subsequently, an amount of heat needed for ejecting air will be theoretically described. In this description, the temperature of air needed for ejection will be first computed, and then the amount of heat (an amount of heating power) will be then computed.

In the case where the temperature of air in the liquid chamber 50 is increased by heating, when it is assumed that the volume of the flow path can be neglected because of being very much smaller than the volume of air in the area upstream of the filter 23, the Boyle-Charles law can be applied. When the internal pressure and the internal temperature of the liquid chamber 50 before heating are respectively represented by Ph and Th, and when those after heating are respectively represented by Ph' and Th', the following expression (17) or (17') (in a further organized form) is obtained:

$$Ph/Th=Ph'/Th'(Th<Th') \quad (17) \text{ or}$$

$$Ph'=(Th'/Th)\times Ph \quad (17').$$

Since the condition for resolving the multiple meniscus state is such that Ph' is greater than (Hs−Ha'), the condition is given as below in an organized form:

$$Th'>2n\times\gamma i\times Th(\cos\theta 1-\cos\theta 2)/(Ph\times Ra) \quad (18).$$

Thus, when the internal temperature of the liquid chamber 50 after heating satisfies the expression (17), the multiple meniscus state is resolved, and air in the liquid chamber is ejected to the ink-storing chamber 12.

Next, a necessary amount of heat will be described. The intention here is to compute an amount of heating power for heating the air up to the above-mentioned temperature, under the condition that heating power of the electric resistor 61 is applied on 100% of the air. When an amount of heating power W is used to increase the temperature of the air in the liquid chamber 50 up to the above temperature in ten seconds, the heating power W is given by the following expression:

$$W=1.16\times C\times d\times Vh\times\Delta Th\times 360/\eta \quad (19),$$

where C is a specific heat of air (=0.24(Kcal/Kg/° C.), d is a density of air (=1.25(Kg/m$^3$), ΔTh is equal to (Th'−Th) (° C.), and η is an efficiency (<1). When η is set at 0.9, and it is assumed that the expression (18) is equality, the necessary heating power W is represented by the following expression:

$$W>278.4\times n\times\gamma i\times Th\times Vh(\cos\theta 1-\cos\theta 2)/Ph\times Ra \quad (20).$$

In the strict sense, since a part of applied heat is absorbed by the wall of the liquid chamber 50 or by ink, or is dissipated, an amount of power slightly greater than the heating power obtained by the expression (20) should be supplied. Hence, by applying the above-described heating power and an additional amount of power, the foregoing multiple meniscus state can be resolved.

Third Embodiment

Figure 18:
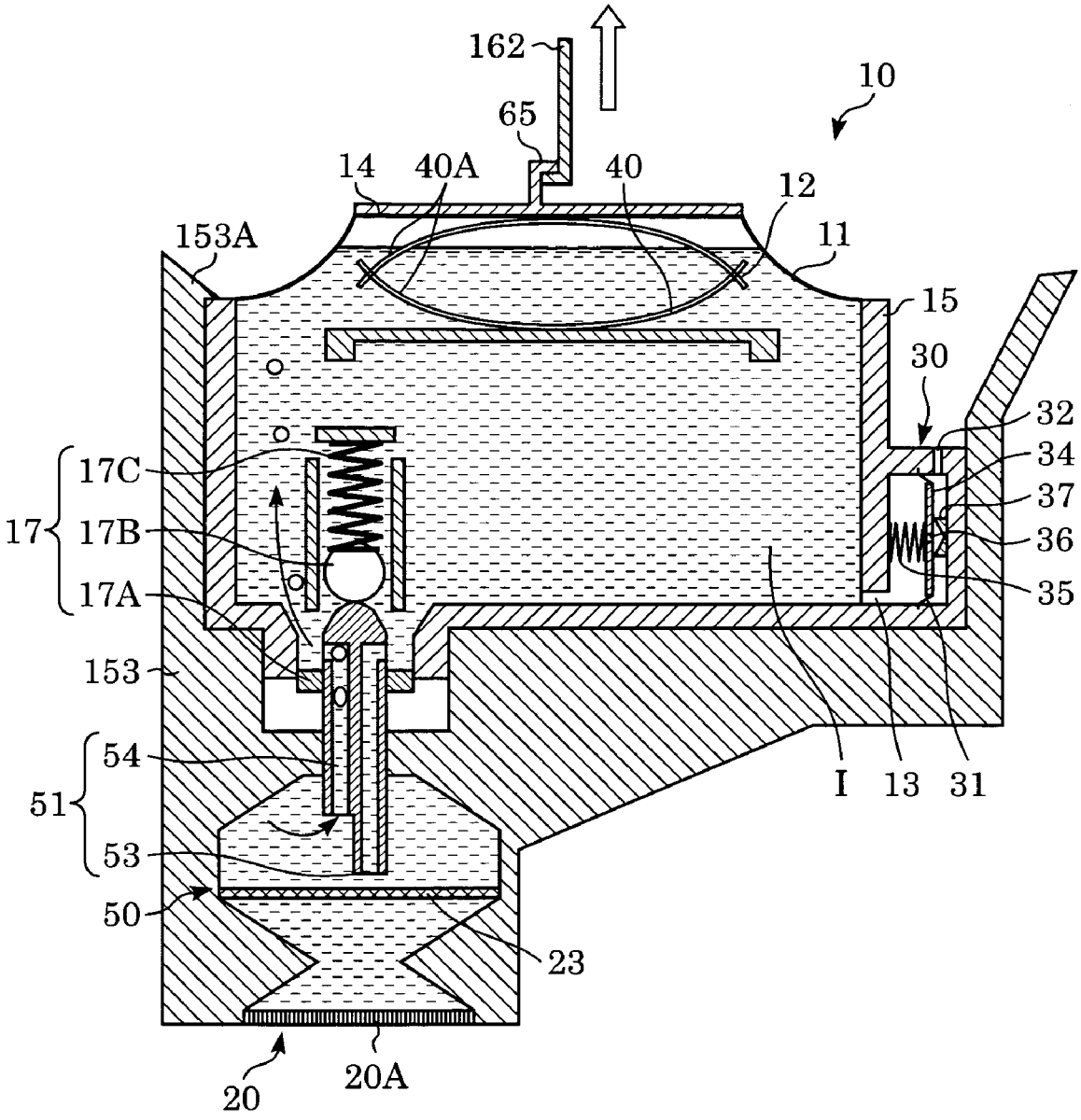
FIG. 18 is a schematic sectional view illustrating the structure of a liquid-feeding system according to a third embodiment of the present invention and the principle of gas ejection in the system.

Referring to FIG. 18, the structure and an operation of an ink-feeding system according to a third embodiment will be described. The same parts as in the first embodiment are identified by the same reference characters as in the first embodiment.

In the present embodiment, different from the first and second embodiments, the spring 40 and the pressure plate 14 serving as a buffer of the ink tank 10, and a pulling-up member 162 pulling up these components are used as the pressure-changing means. That is, in order to resolve the multiple meniscus state, the internal pressure of the ink-storing chamber is decreased (the internal negative of the same is increased) by reducing the internal volume of the ink-storing chamber so as to increase a difference in the internal pressures of the ink-storing chamber and the liquid chamber 50.

The pressure plate 14 has an engaging claw 65 disposed thereon, protruding therefrom and being engageable with the pulling-up member 162. When the pulling-up member 162 moves downward from above the ink tank 10, engages with the engaging claw 65 and then moves above the ink tank 10, the pressure plate 14 follows the movement of the pressure plate 14 and is displaced, whereby the internal volume of the ink-storing chamber 12 is increased.

Since the ink-storing chamber 12 is enclosed, when its internal volume is increased, it is instantaneously decompressed. When the ink-storing chamber 12 is instantaneously decompressed as described above, since the internal pressure of the liquid chamber 50 becomes higher than that of the ink-storing chamber 12, ink and air in the liquid chamber 50 tend to move to the ink-storing chamber 12 through the respective flow paths so as to maintain the pressure balance between two chambers. In this state, since the ink flow path 53 and ink have respective resistances, the ink flow path 53 alone cannot deal with such an instantaneous pressure change. As a result, air in the area upstream of the filter 23 is introduced into the ink-storing chamber 12 through the air flow path 54. Accordingly, air in the liquid chamber 50 is ejected to the ink-storing chamber 12; thus, the multiple meniscus state is resolved.

Also, in the present embodiment, in the same fashion as in the first and second embodiments, as shown FIG. 13, after the ink tank 10 is placed, the pulling-up member 162 making up the pressure-changing means is controlled so as to be activated. With this activation, the multiple meniscus state is solved before the recordable state is established.

Next, a pressure decrement caused by the displacements of the spring member 40 and the pressure plate 14 with the pulling-up member 162 will be theoretically described.

The internal volume and the internal pressure of the ink-storing chamber 12 before the pulling-up operation are respectively represented by Vt and Pt, and those in the liquid chamber 50 after the pulling-up operation are respectively represented by Vt' and Pt'. Since the liquid chamber 50 is enclosed, when it is assumed that the internal temperature of the liquid chamber 50 does not vary in accordance with the pulling-up operation, the Boyle-Charles law provides the expression (21), and thus, the internal pressure Pt' of liquid chamber 50 after the pulling-up operation is given by the expression (21'):

$$Pt \times Vt = Pt' \times Vt' (Vt < Vt') \quad (21) \text{ and}$$

$$Pt' = (Vt/Vt') \times Pt \quad (21').$$

A pressure decrement ΔPt of the inner pressure of the ink-storing chamber 12 is given by the following expression:

$$\Delta Pt = Pt - (Vt/Vt') \times Pt \quad (22) \text{ or}$$

$$\Delta Pt = (1 - Vt/Vt') \times Pt \quad (22').$$

Thus, since the condition for resolving the multiple meniscus state is such that ΔPt given by the expression (22') is greater than (Hs'−Ha'), the condition is represented in an organized form as below:

$$Vt' > Pt \times Ra \times Vt / (Pt \times Ra - 2\gamma i \times n(\cos \theta 1 - \cos \theta 2)) \quad (23).$$

As a result, when the spring member 40 and the pressure plate 14 are pulled up by the pulling-up member 162 which is a feature of the present embodiment, by deforming the internal space (by increasing the internal volume) of the ink-storing chamber 12 so as to satisfy the expression (23), the multiple meniscus state is resolved, and air is accordingly ejected to the ink-storing chamber 12.

Subsequently, an example structure of an ink-jet recording apparatus will be described.

Figure 19:
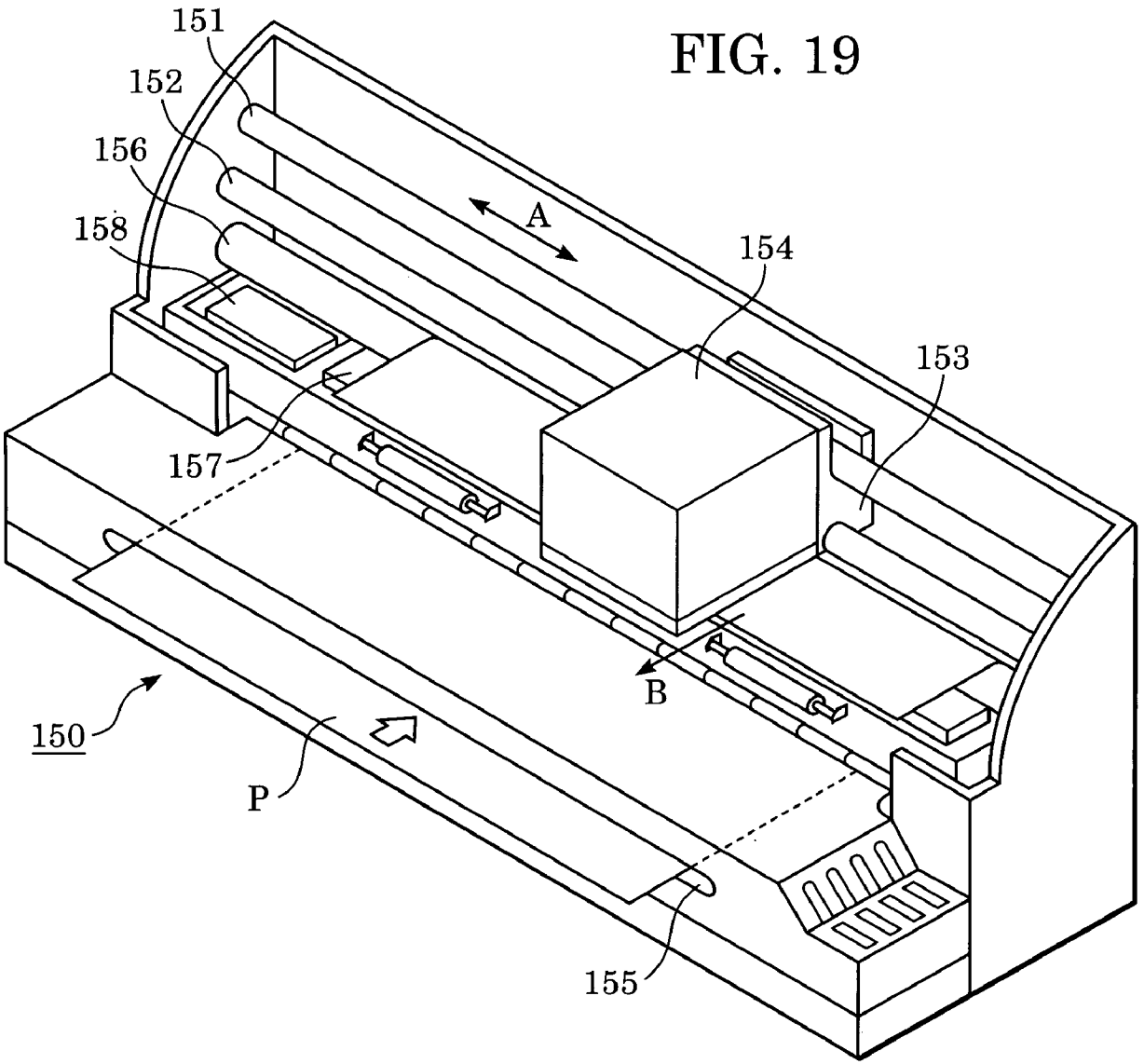
FIG. 19 is a perspective view of an example structure of an inkjet recording apparatus to which the present invention is applicable.
Figure 20:
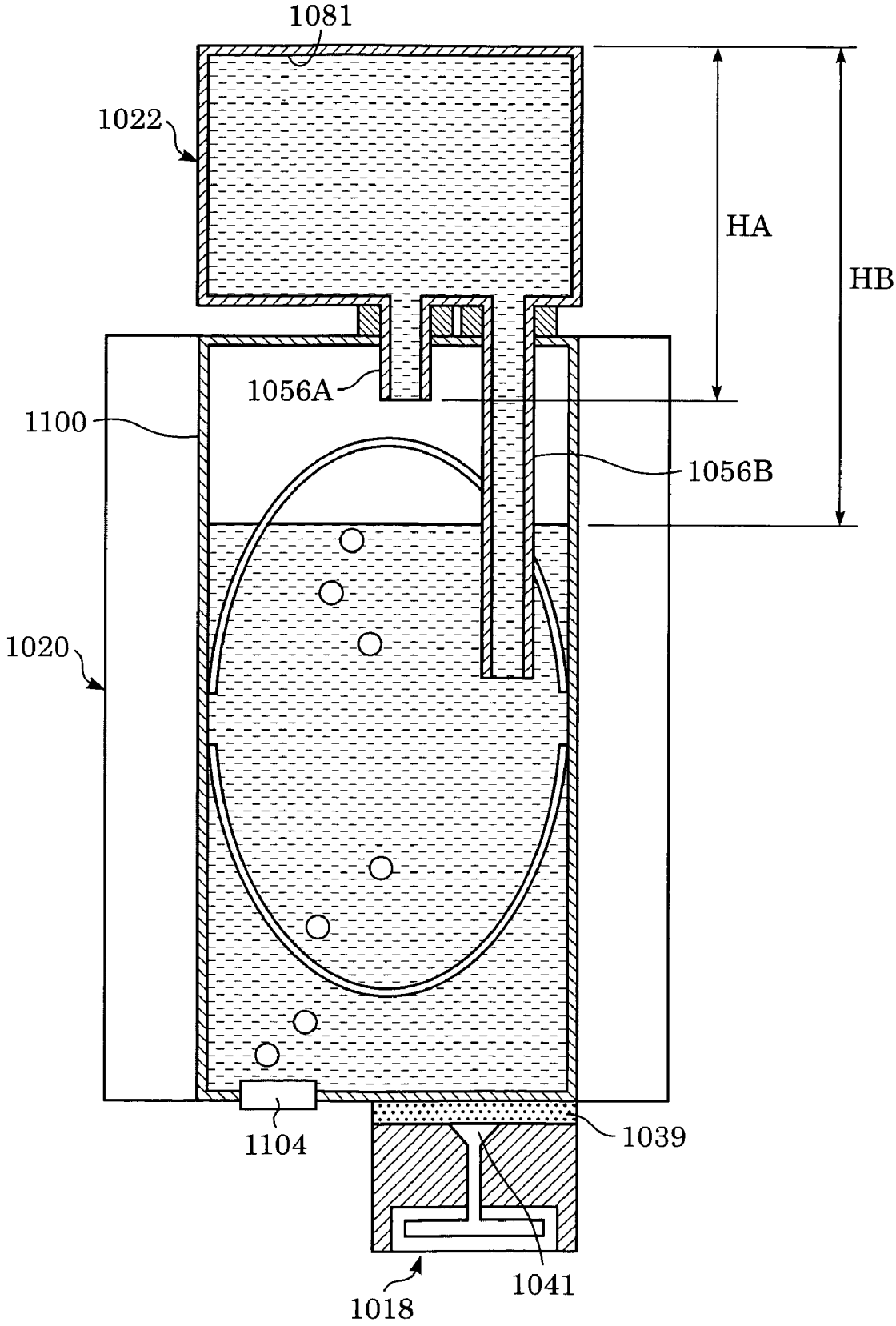
FIG. 20 PRIOR ART
FIG. 20 is a sectional view of a known ink-feeding system.

FIG. 19 is a perspective view of an example structure of an example inkjet recording apparatus to which the present invention is applicable.

An example recording apparatus 150, the structure of which will be described below, is a serial-scanning-type inkjet recording apparatus. The carriage 153 is guided by guide shafts 151 and 152 so as to be movable in the main scanning direction shown by the arrow A indicated in the figure and is driven in a reciprocating manner by a carriage motor and a drive-force transmitting mechanism such as a belt, transmitting a drive force of the motor. Also, the carriage 153 has a liquid-feeding system 154 (see, for example, FIG. 1) mounted thereon, to which any one of the above-described embodiments is applicable. The liquid-feeding system 154 includes a recording head or a liquid chamber and an ink tank placed on the recording head or the liquid chamber so as to feed ink to the same. A sheet of paper P as a recording medium is inserted through a slot 155 disposed at the front of the apparatus, its transporting direction is reversed, and is then transported by a feed roller 156 in the sub-scanning direction shown by the arrow B indicated in the figure. The recording apparatus 150 forms images one after another on the sheet of paper P by repeating (i) a recording operation of discharging ink toward a recording area of the sheet of paper P lying on a platen 157 and (ii) a transporting operation of transporting the sheet of paper P in the sub-scanning direction by a distance corresponding to the recording width of the recording operation, while moving the recording head in the main scanning direction.

The recording head may be formed by using the electrothermal conversion member generating thermal energy for discharging ink as described above. In this case, heat generated by the electrothermal conversion member causes film-boiling to occur in ink, and bubble-forming energy generated in accordance with the film-boiling causes ink to be discharged from an ink-discharge port. Also, an ink-discharging system of the recording head is not limited only to the above-described one in which such an electrothermal conversion member is used, and it may be achieved by using, for example, a piezoelectric element for discharging ink.

The recording apparatus has a recovery system unit (recovery-processing means) 158 disposed at the left end in FIG. 19, of the moving area of the carriage 153 so as to face the ink-discharge-port-forming surface of the recording head mounted on the carriage 153. The recovery system unit 158 includes a cap capping the ink-discharge port of the recording head, a suction pump capable of introducing a negative pressure in the cap, and so forth. By introducing a negative pressure in the cap covering the ink-discharge port so as to suck and discharge ink through the ink-discharge port, the recovery system 158 performs a recovery process for maintaining the recording head in a satisfactory ink-discharging state. Independent of an operation for forming an image, by discharging ink toward the inside of the cap through the ink-discharge port, the recovery process (also, called a preliminary discharge process) for maintaining the recording head in a satisfactory state can be also performed. When a new ink tank is placed, these processes can be also conducted so as to satisfy the condition represented by the foregoing expression (4).

Subsequently, alternative structures applicable to the foregoing first to third embodiments will be described.

In the foregoing first to third embodiments, by increasing the internal pressure of the liquid chamber 50 (in the first and second embodiments) or by reducing the internal pressure of the ink-storing chamber 12 (in the third embodiment), the pressure balance between the liquid chamber 50 and the ink-storing chamber 12 is changed so as to resolve the multiple meniscus state in the air flow path 54.

The present invention is not limited to the above structure. Instead, by reducing the internal pressure of the liquid chamber 50 or by increasing the internal pressure of the ink-storing chamber 12, the pressure balance can be changed so as to resolve the multiple meniscus state in the air flow path 54. Meanwhile, different from those in the foregoing three embodiments, this structure causes ink and air making up the multiple meniscus state in the liquid chamber 50 to be ejected and accordingly meets the requirement of resolving the multiple meniscus state in the air flow path 54. Also, even when air is ejected to the liquid chamber 50, since air can be transferred to the ink-storing chamber 12 as long as the multiple meniscus state is resolved, this structure is applicable to the recording apparatus according to the present invention without causing problems at all.

Also, in each of the foregoing three embodiments, although the liquid chamber 50 has the connecting portion 51 integrally formed therewith, the present invention is not limited to such a structure; alternatively, the ink tank 10 may have the connecting portion 51 disposed therein so as to achieve the same effect as in the foregoing embodiments. Also, in each of the foregoing three embodiments, although a single of the connecting portion 51 has two flow paths disposed therein; alternatively, two connecting portions, each having a single flow path disposed therein may be used. In this case, for example, of the two connecting portions, one for the ink flow path and the other for the air flow path may be disposed respectively closed to the ink tank 10 and the liquid chamber 50. With this structure, the same operation and effect as in the foregoing three embodiments can be achieved; hence this structure also falls in the scope of the present invention.

Also, in any of the embodiments, the number of flow paths is not limited to two, and the number may be three or more. In addition, when the inside of the connecting portion is divided so as to form a plurality of flow paths, the connecting portion is not limited to such a structure in which a partition wall between adjacent flow paths extends straight in the same fashion as in the foregoing three embodiments, and it may have a multiple-tube structure in which a plurality of flow paths are concentrically formed.

Furthermore, when the inside of the connecting portion is divided so as to form a plurality of flow paths, each flow path is not required to be completely defined as long as mutual interference between gas transfer and ink movement does not inhibit smooth and quick gas-liquid exchange.

In the foregoing embodiments, although the valve chamber 30 for introducing outside air into the ink tank 10 is formed integrally with the ink tank 10, when outside air can be directly introduced into the ink tank 10 without passing through the liquid chamber 50, the valve chamber is not always required to be formed integrally with the ink tank. For example, by disposing the valve chamber close to the carriage 153, the valve chamber and the ink tank can be in an internal direct communication with each other in accordance with a placement action of the ink tank.

Each of the ink-feeding systems according to the foregoing embodiments basically has a structure in which ink is stored as it is without being held in a form or the like or is fed as it is, and in which the negative pressure-generating means is made up by the movable members (the sheet member and the pressure plate) and by the spring member urging these members. At the same time, the ink-feeding system is formed so as to have an enclosed structure; thus, an appropriate negative pressure is exerted on the recording head.

With the structure of each of the ink-feeding systems according to the above-described embodiments, its volumetric efficiency is greater than that in the known art in which a negative pressure is generated by a form, and also versatility of possible ink selection is increased. In addition, the structure can satisfactorily meet the requirement of feeding ink at high speed on the basis of a request for high-speed recording in recent years.

In order to achieve ejection of gas staying in the ink-feeding pathway, which is the main intention of the present invention by transferring the gas to the ink tank lying remotest from the recording head, that is, lying uppermost-stream, the ink tank and the ink-feeding pathway are connected with each other, having a plurality of flow paths interposed therebetween, and by making use of the pressure balance between the ink tank and the ink-feeding pathway, ink is drained from the ink tank; at the same time, gas in the ink-feeding pathway is introduced to the ink tank.

With such a structure, gas staying in the ink-feeding pathway can be smoothly and quickly ejected to the ink tank without making the structure of the apparatus complicated and without increasing the number of components so much with the structure being simple. Also, since gas is ejected in accordance with the pressure balance, the gas ejection is reliably performed.

Also, in the gas ejection process, since the ink tank is always maintained in a negative pressure state, liquid is reliably prevented from leaking from an ink-discharge port of the inkjet recording head. In addition, since gas is ejected to the ink tank, an amount of consumed ink can be remarkably reduced compared to that when gas is ejected by sucking ink through a discharge port of the recording head, thereby curbing ink consumption and thus contributing to reduction in an operating cost.

In addition, when an ink tank detachable from the ink-feeding pathway is used, in order to prevent gas from entering the ink-feeding pathway during a replacement operation of the ink tank, hitherto, the ink tank is often replaced with a new one in a state in which the ink-feeding pathway is filled with ink, that is, before ink is completely consumed up. On the contrary, with the above-described structure, even when gas enters the liquid chamber before replacement or during the replacement operation, when the new ink tank is placed, gas can be easily and quickly ejected to the ink new tank in accordance with the placement; accordingly, the ink tank can be replaced with a new one after ink is completely consumed up. Thus, this structure not only promotes further reduction in an operating cost but also contributes to solving an environmental problem on a large scale. In addition, in any of the foregoing embodiments, in a normal operation mode, the ink tank is disposed at the highest part of the recording apparatus, and the liquid chamber or the recording head is disposed at a low part of the same. This arrangement is very preferable for achieving quick and smooth gas-liquid exchange with a simple structure.

Also, when ink including pigment as color material is used, when air is transferred to the ink tank, precipitation of pigment particles is diffused, thereby stably reserving ink and reliable discharging it.

On top of the above advantages, since ink is fed in a state in which a negative pressure exerted on the recording head is stabilized, improvements in recording performances and reliability and reduction in cost are achieved at the same time.

Although depending on the structure of the ink tank, gas introduced in the ink tank may be trapped anywhere in the ink tank instead of being returned to the ink-feeding pathway, as long as the trapping place does not prevent ink from being fed. Hence, the structure of each of the liquid feeding systems according to the foregoing embodiments in which ink is stored as it is without being contained in a form or the like is preferable since introduced gas stays at the highest part of the ink tank.

Unless a form exists in the ink tank as described above, the volume of the ink tank can be utilized as an ink-storing space, whereby the ink tank is required to have a larger volume than necessary, and also the versatility of possible design feature of the shape of the ink tank increases relatively.

The basic conditions making up the present invention lie in that the liquid chamber has an enclosed structure excepting for the connection portions with the ink tank and the recording head, so as to accommodate ink in its enclosed space as it is; and also in that, in order to maintain a preferable negative pressure, atmospheric air is directly introduced to the ink tank so as to minimize gas entering the recording head. These conditions are very preferable for stably feeding ink at high speed and for always maintaining excellent discharging characteristics even at high-speed recording (high-speed discharging), and are not disclosed or suggested in any one of Japanese Patent Laid-Open No. 5-96744, and U.S. Pat. Nos. 6,460,984, 6,347,863, 6,022,102, and 6,520,630.

As long as such basic conditions are satisfied, the negative-pressure-generating means may also have a structure other than a combination of a spring and a flexible member employed in the foregoing embodiments. That is, the basic conditions of the present invention do not exclude employment of a form as the negative-pressure-generating means.

Also, in the above description, a serial type inkjet recording apparatus is applied to the present embodiment, the present invention and the present embodiment are not limited to the above one. The present invention and the present embodiment are applicable to a line-scanning type recording apparatus in addition to serial-type one. In addition, those skilled in the art will appreciate that a plurality of liquid-feeding systems can be disposed so as to correspond to a tone of color (color, density, and the like) of ink.

Furthermore, in the above description, although the present invention is applied to an ink tank feeding ink to a recording head, the present invention may be applied to a feeding unit feeding ink to a pen serving as a recording unit.

Moreover, the present invention is widely applicable to apparatuses for feeding a variety of kinds of liquid such as drinking water, and liquid seasoning, and also to medical systems for feeding medical, other than such various types of recording apparatuses.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid-feeding system comprising:

a liquid-using unit;

a liquid chamber in communication with the liquid-using unit and adapted to hold liquid;

a liquid storage storing liquid and attachable to the liquid chamber;

a plurality of communication paths facilitating communication between the liquid chamber and the liquid storage and provided to the liquid chamber, the plurality of communication paths having a liquid flow path introducing the liquid in the liquid storage to the liquid chamber and an air flow path moving the air in the liquid chamber to the liquid storage;

a pressure regulator disposed in the liquid storage and regulating the internal pressure of the liquid storage, wherein a space other than the plurality of communication paths and the liquid-using unit is substantially sealed and formed in the liquid chamber, wherein the liquid-feeding system changes the pressure equilibria in both of the liquid chamber and the liquid storage; and a pressure-changing unit configured to make the pressure in the liquid chamber comparatively higher than the pressure in the liquid storage, so as to move air in the liquid chamber to the liquid storage through the air flow path, wherein the pressure-changing unit includes a member and activating means, wherein the member defines at least a part of the liquid chamber, and wherein the activating means changes the pressure in the liquid chamber by being disposed at a part other than the liquid chamber and operating on the member.

2. The liquid-feeding system according to claim 1, wherein the pressure regulator regulates the internal pressure of the liquid storage to be lower than atmospheric pressure.

3. The liquid-feeding system according to claim 1, wherein the member includes an elastic member defining at least a part of the liquid chamber, and wherein the activating means engages the elastic member to deform the elastic member so as to change an internal volume of the liquid chamber.

4. The liquid-feeding system according to claim 3, wherein the activating means includes a pressing member exerting a pressing force to deform the elastic member such that the internal volume of the liquid chamber is reduced.

5. The liquid-feeding system according to claim 1, wherein the pressure-changing means includes heating means disposed in the liquid chamber to heat gas in the liquid chamber.

6. The liquid-feeding system according to claim 1, wherein the pressure regulator comprises:

means for introducing in the liquid-using unit a negative pressure state relative to the atmospheric pressure; and means for directly introducing the atmospheric air into the liquid storage without passing through the liquid chamber in order to regulate the negative pressure state.

* * * * *